US010747159B2

(12) United States Patent
Ohkubo et al.

(10) Patent No.: US 10,747,159 B2
(45) Date of Patent: Aug. 18, 2020

(54) IMAGE FORMING APPARATUS, DISCRIMINATION SYSTEM AND UNIT DISCRIMINATION METHOD OF IMAGE FORMING APPARATUS

(71) Applicant: CANON KABUSHIKI KAISHA, Tokyo (JP)

(72) Inventors: Takateru Ohkubo, Susono (JP); Kazuki Takase, Mishima (JP); Yoshimi Suzuki, Numazu (JP); Hiroyuki Yamano, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/131,665

(22) Filed: Sep. 14, 2018

(65) Prior Publication Data

US 2019/0101856 A1 Apr. 4, 2019

(30) Foreign Application Priority Data

Sep. 29, 2017 (JP) ..... 2017-190139

(51) Int. Cl.
*G03G 15/00* (2006.01)
*G03G 15/16* (2006.01)
(Continued)

(52) U.S. Cl.
CPC ..... *G03G 15/5054* (2013.01); *G03G 15/1605* (2013.01); *G03G 15/1615* (2013.01);
(Continued)

(58) Field of Classification Search
CPC ..... G03G 2221/16; G03G 2221/1642; G03G 2221/18; G03G 2221/1807;
(Continued)

(56) References Cited

U.S. PATENT DOCUMENTS 9,996,029 B2 6/2018 Matsumoto et al.
2006/0177230 A1* 8/2006 Ishii ..... G03G 15/80 399/12
2006/0245785 A1* 11/2006 Kawamura ..... G03G 21/181 399/111
2007/0059018 A1* 3/2007 Tokuda ..... G03G 15/0806 399/90
(Continued)

FOREIGN PATENT DOCUMENTS

JP 09-190136 A 7/1997
JP 2009-128710 A 11/2009
JP 2014-238531 A 12/2014

*Primary Examiner* — Ryan D Walsh
(74) *Attorney, Agent, or Firm* — Venable LLP

(57) ABSTRACT

An image forming apparatus includes an apparatus body and a unit detachably mounted to the apparatus body and comprising a unit body, a cam, a first movement member, and a second movement member. The unit includes a first contact portion, an urging portion, and a second contact portion. The second movement member is attachable to the first movement member in a first manner or a second manner. A detection pattern of a detection signal differs between a state in which the second movement member is in contact with the first contact portion and a state in which the second movement member is in contact with the second contact portion, and differs between a state in which the second movement member is attached in the first manner and a state in which the second movement member is attached in the second manner.

22 Claims, 24 Drawing Sheets

(51) Int. Cl.
*G03G 21/16* (2006.01)
*G03G 21/18* (2006.01)

(52) U.S. Cl.
CPC ..... *G03G 21/168* (2013.01); *G03G 21/1642* (2013.01); *G03G 21/1647* (2013.01); *G03G 21/1892* (2013.01); *G03G 2215/0183* (2013.01); *G03G 2221/16* (2013.01); *G03G 2221/1642* (2013.01); *G03G 2221/18* (2013.01); *G03G 2221/1807* (2013.01); *G03G 2221/1869* (2013.01); *G03G 2221/1892* (2013.01)

(58) Field of Classification Search
CPC ... G03G 2221/1869; G03G 2221/1892; G03G 21/1642; G03G 21/1647; G03G 21/168; G03G 21/1892; G03G 15/5054; G03G 15/1605; G03G 15/1615; G03G 2215/0183
See application file for complete search history.

(56) References Cited

U.S. PATENT DOCUMENTS

2007/0122165 A1* 5/2007 Igarashi ..... G03G 15/0822 399/12
2007/0160388 A1* 7/2007 Yoshimura ..... G03G 21/1825 399/111
2009/0252517 A1* 10/2009 Tachiki ..... G03G 15/0136 399/66
2009/0279905 A1* 11/2009 Zensai ..... G03G 15/1605 399/12
2015/0117874 A1* 4/2015 Shiraki ..... G03G 21/1676 399/13
2016/0070220 A1* 3/2016 Ueda ..... G03G 15/553 399/12
2017/0261883 A1* 9/2017 Kyotani ..... G03G 15/0863
2018/0292777 A1 10/2018 Suzuki
2019/0004455 A1 1/2019 Takase

* cited by examiner

MODEL 1: NEW STATE

MODEL 4:
NORMAL STATE

IMAGE FORMING APPARATUS, DISCRIMINATION SYSTEM AND UNIT DISCRIMINATION METHOD OF IMAGE FORMING APPARATUS

BACKGROUND OF THE INVENTION

Field of the Invention

The present invention relates to an image forming apparatus for forming an image, a discrimination system, and a unit discrimination method of an image forming apparatus.

Description of the Related Art

Hitherto, in an image forming apparatus adopting an electro-photographic system, a configuration is adopted where units having reached their predetermined service lives are replaceable. Known examples of replaceable units include process cartridges, transfer belt units and fixing units. A process cartridge is a unit including a photosensitive drum and a cleaner, a developer unit and so on, and each unit is replaceable in the image forming apparatus body. The transfer belt unit is composed of a photosensitive drum, a transfer roller for transferring the toner image formed on an intermediate transfer belt to a transfer material, a belt member, a stretch roller and so on, and the unit is replaceable in the image forming apparatus body.

The fixing unit includes a fixing roller and a heating roller for fixing the transferred toner image to a transfer material, and it is replaceable in the image forming apparatus body. These replaceable units are treated as consumables, and they are replaced by a user or a service technician when their service life has expired.

Hitherto, according to Japanese Patent Application Laid-Open Publication No. 2009-128710, there has been proposed a printer capable of detecting a rib formed on a rotatable input gear provided on a developing cartridge using a dedicated optical sensor. In this printer, an initial phase of the input gear differs for each of a plurality of types of new and old developing cartridges having different toner capacities. In an initialization processing when the developing cartridge is attached to the apparatus body, the type and status (old/new) of the developing cartridge are determined based on a detection status and detection time of the optical sensor. If it is determined that the attached developing cartridge is new, a print count value for recognizing a remaining amount of toner is initialized.

However, according to the input gear disclosed in Japanese Patent Application Laid-Open Publication No. 2009-128710, if a toothless portion of the input gear opposes a drive gear during the initialization processing, the drive will not be entered, and the input gear will not rotate. In other words, the input gear and the optical sensor are dedicated parts that determine the type of the developing cartridge and whether the developing cartridge is old or new, and they will not be used after the initialization processing. Therefore, a sensor only dedicated to detecting the type of the developing cartridge and whether it is old or new had to be provided, increasing the cost of the apparatus.

SUMMARY OF THE INVENTION

According to a first aspect of the present invention, an image forming apparatus includes an apparatus body including an image forming portion configured to form an image, and a detection portion configured to turn in a first state and a second state and configured to output a detection signal corresponding to the first state and the second state, and a unit detachably mounted to the apparatus body and including a unit body, a cam rotatably supported on the unit body and configured to position at least at two rotation positions, a first movement member configured to move with respect to the unit body by rotation of the cam, and a second movement member movably supported with respect to the first movement member and turning the detection portion to the first state and to the second state by movement of the first movement member. The unit includes a first contact portion provided on the first movement member and being in contact with the second movement member so as to position the second movement member with respect to the first movement member, an urging portion configured to urge the second movement member toward the first contact portion, and a second contact portion provided on the unit body and configured to contact the second movement member separated from the first contact portion and urged by the urging portion. The second movement member is attachable to the first movement member in a first manner or a second manner that differs from the first manner, in a state in which the second movement member, regardless of the first and second manners, is in contact with the second contact portion, the second movement member moves away from the second contact portion while the cam rotates once so that the second movement member is positioned at the first contact portion by urging force of the urging portion. A detection pattern of a detection signal output by the detection portion while the cam rotates once differs between a state in which the second movement member is in contact with the first contact portion and a state in which the second movement member is in contact with the second contact portion, and differs, in the state in which the second movement member is in contact with the second contact portion, between a state in which the second movement member is attached in the first manner and a state in which the second movement member is attached in the second manner.

According to a second aspect of the present invention, a discrimination system includes an apparatus body including an image forming portion configured to form an image, and a detection portion configured to turn in a first state and a second state and configured to output a detection signal corresponding to the first state and the second state, and a controller configured to discriminate whether a unit attached to the apparatus body is a first unit or a second unit. The first unit is detachably mounted to the apparatus body and includes a first unit body, a first cam rotatably supported on the first unit body and configured to position at least at two rotation positions, a first unit movement member configured to move with respect to the first unit body by rotation of the cam, and a first unit flag member movably supported with respect to the first unit movement member and turning the detection portion to the first state and to the second state by movement of the first unit movement member. The second unit is detachably mounted to the apparatus body and includes a second unit body, a second cam rotatably supported on the second unit body and configured to position at least at two rotation positions, a second unit movement member configured to move with respect to the second unit body, and a second unit flag member movably supported with respect to the second unit movement member and turning the detection portion to the first state and to the second state by movement of the second unit movement member. The controller is configured to discriminate whether a unit attached to the apparatus body is the first unit or the second unit based on a difference between a detection pattern of the detection signal output by the detection portion while the first cam or the second cam rotates once.

A third aspect of the present invention is directed to a unit discrimination method of an image forming apparatus including an apparatus body capable of having a plurality of types of units attached thereto, and a detection portion configured to turn in a first state and a second state and configured to output a detection signal corresponding to the first state and the second state. The unit discrimination method includes a rotation step of rotating a cam provided on a unit attached to the apparatus body once, a detection step of detecting a detection signal output by the detection portion turned in the first state and the second state in the rotation step, wherein a detection pattern of the detection signal output by the detection portion while the cam rotates once differs according to a type of the unit, and a discrimination step of discriminating the type of the unit based on the detection pattern detected during the detection step.

Further features of the present invention will become apparent from the following description of exemplary embodiments with reference to the attached drawings.

DESCRIPTION OF THE EMBODIMENTS

First Embodiment

General Configuration

Figure 1:
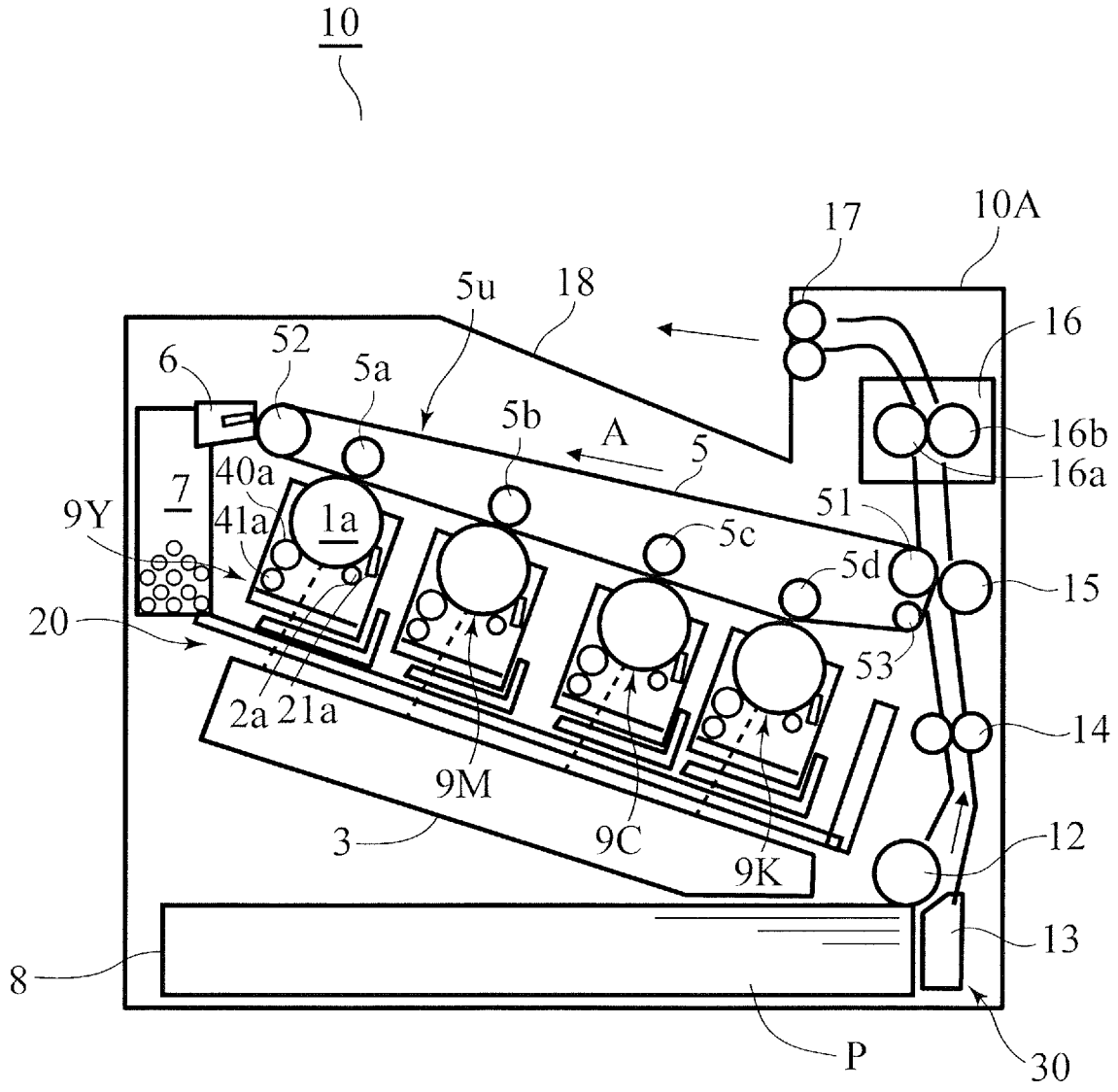
FIG. 1 is an overall schematic drawing illustrating a printer according to a first embodiment.

Now, a first embodiment of the present invention will be described. A printer 10 serving as an image forming apparatus according to the first embodiment is an electro-photographic laser beam printer. As illustrated in FIG. 1, the printer 10 includes an image forming unit 20 for forming an image on a sheet P, a sheet feeding portion 30, a fixing unit 16 and a sheet discharge roller pair 17. The image forming unit 20 includes four process cartridges 9Y, 9M, 9C and 9K respectively forming a toner image of yellow (Y), magenta (M), cyan (C) and black (k), a laser scanner 3 and a transfer unit 5*u*. The four process cartridges 9Y, 9M, 9C and 9K and the laser scanner 3 constitute an image forming portion.

The four process cartridges 9Y, 9M, 9C and 9K are arranged in an inclined manner with the process cartridge 9Y arranged higher and process cartridges 9M, 9C and 9K arranged gradually lower. This arrangement is adopted to downsize the width of the printer 10. The laser scanner 3 is arranged below the process cartridges 9Y, 9M, 9C and 9K, and the transfer unit 5*u* is arranged above the process cartridges 9Y, 9M, 9C and 9K.

The four process cartridges 9Y, 9M, 9C and 9K adopt the same configuration except for the difference in the color of the image being formed. Therefore, only the configuration and image forming process of process cartridge 9Y will be described, and the descriptions of process cartridges 9M, 9C and 9K will be omitted.

The process cartridge 9Y includes a photosensitive drum 1*a* as an image bearing member, a charge roller 2*a*, a developing roller 40*a*, a developer coating roller 41*a* that supplies developer to the developing roller 40*a*, and a cleaning blade 21*a*. The photosensitive drum 1*a* is composed by applying an organic photoconductive layer on an outer circumference of an aluminum cylinder and is driven to rotate clockwise in FIG. 1 by a drive motor (not shown).

The transfer unit 5*u* serving as a unit includes an intermediate transfer belt 5 that is stretched around a secondary transfer counter roller 51, a drive roller 52 and a tension roller 53, and a cleaning apparatus 6 that opposes to the drive roller 52 intervening the intermediate transfer belt 5. Primary transfer rollers 5*a*, 5*b*, 5*c* and 5*d* serving as a plurality of transfer members opposing to respective photosensitive drums of process cartridges 9Y, 9M, 9C and 9K are provided on an inner side of the intermediate transfer belt 5 serving as an intermediate transfer body. A secondary transfer roller 15 is provided on an opposite side of the secondary transfer counter roller 51 intervening the intermediate transfer belt 5.

The fixing unit 16 includes a fixing roller 16*a* heated by a heater, and a pressure roller 16*b* pressed against the fixing roller 16*a*. The sheet feeding portion 30 is provided at a lower portion of the printer 10, and includes a cassette 8 that stores sheets P. The sheets P stored in the cassette 8 are fed by a pickup roller 12 and separated sheet by sheet by a separation pad 13. Instead of the separation pad 13, a separation roller that provides a predetermined conveyance resistance to the sheet using a torque limiter may be provided.

Next, we will describe an image forming operation of the printer 10 configured as above. If an image signal is entered to the laser scanner 3 from a personal computer and the like (not shown), a laser beam corresponding to the image signal is irradiated on the photosensitive drum 1*a* of the process cartridge 9Y.

In this state, a surface of the photosensitive drum 1*a* is charged uniformly to predetermined polarity and potential in advance by a charge roller 2*a*, and an electrostatic latent image is formed on the surface by having laser beams irradiated from the laser scanner 3. The electrostatic latent image formed on the photosensitive drum 1*a* is developed by the developing roller 40*a*, and a yellow (Y) toner image is formed on the photosensitive drum 1*a*.

Similarly, laser beams are irradiated from the laser scanner 3 to the respective photosensitive drums of process cartridges 9M, 9C and 9K, and toner images of magenta (M), cyan (C) and black (K) are formed on the respective photosensitive drums. The toner images of respective colors formed on the respective photosensitive drums are transferred to the intermediate transfer belt 5 by primary transfer bias applied to the primary transfer rollers 5*a*, 5*b*, 5*c* and 5*d*. The full color toner images transferred to the intermediate transfer belt 5 are conveyed to the secondary transfer roller 15 by the intermediate transfer belt 5 rotated in an arrow A direction by the drive roller 52. The image forming process of respective colors is performed at timings set so that the images are superposed on an upstream toner image primarily transferred to the intermediate transfer belt 5.

In parallel with the image forming process, skewing of the sheet P sent out by the sheet feeding portion 30 is corrected by a registration roller pair 14. Further, the registration roller pair 14 conveys the sheet P toward the secondary transfer roller 15 at a matched timing with the toner image conveyed by the intermediate transfer belt 5. A full-color toner image on the intermediate transfer belt 5 is transferred to the sheet P at a nip formed between the secondary transfer counter roller 51 and the secondary transfer roller 15 by secondary transfer bias applied to the secondary transfer roller 15. Further, after transferring the toner image, toner remaining on the photosensitive drum 1*a* is removed by the cleaning blade 21*a* and toner remaining on the surface of the intermediate transfer belt 5 is removed by the cleaning apparatus 6, the removed toner being collected in a waste toner collecting container 7.

Predetermined heat and pressure is applied by the fixing roller 16*a* and the pressure roller 16*b* of the fixing unit 16 to the sheet P to which the toner image has been transferred, and toner is melted and fixed to the sheet P. The sheet P having passed through the fixing unit 16 is discharged onto a sheet discharge tray 18 by the sheet discharge roller pair 17.

Figure 2A:
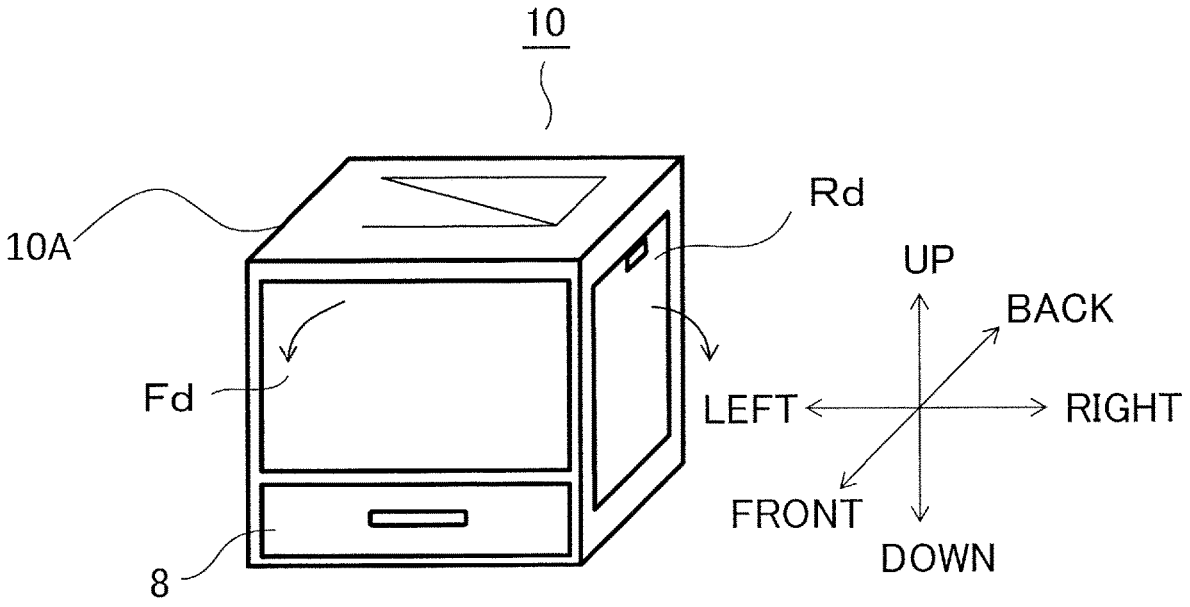
FIG. 2A is a perspective view illustrating a printer.
Figure 2B:
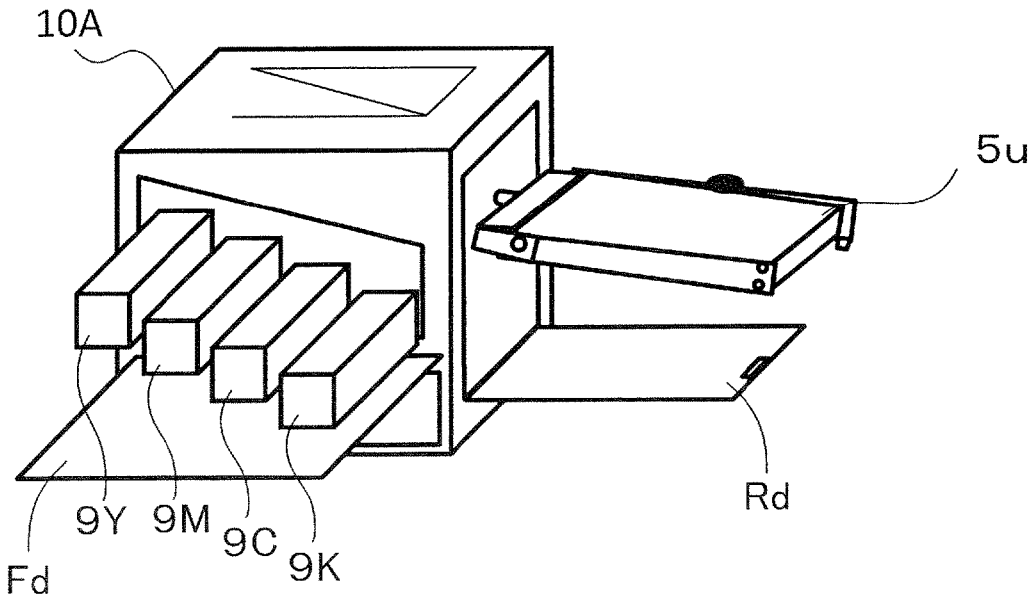
FIG. 2B is a perspective view illustrating how respective units are removed.

As illustrated in FIG. 2A, the printer 10 is configured such that the cassette 8 can be drawn out to the front side from a printer body 10A, wherein a front door Fd is supported in an openable/closable manner above the cassette 8, and a right door Rd is supported in an openable/closable manner on a right side surface of the printer 10. As illustrated in FIG. 2B, the four process cartridges 9Y, 9M, 9C and 9K can be drawn out for replacement to a front side of the apparatus from the printer body 10A serving as the apparatus body after opening the front door Fd. Further, the transfer unit 5*u* is also detachably mounted and replaceable by being drawn out to the right side of the printer body 10A after opening the right door Rd.

The process cartridges 9Y, 9M, 9C and 9K and the transfer unit 5*u* are arranged so that the direction of attachment and detachment with respect to the printer body 10A are orthogonal to each other, and when a predetermined service life has been reached, they are replaced by a user or a service technician.

Transfer Unit

Figure 3A:
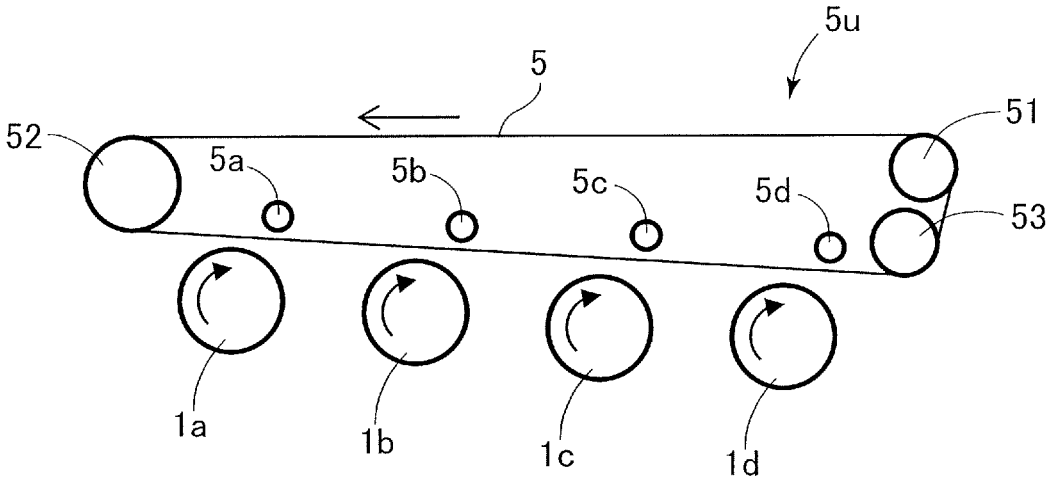
FIG. 3A is a frame format illustrating a transfer unit in an all-separated state.
Figure 3B:
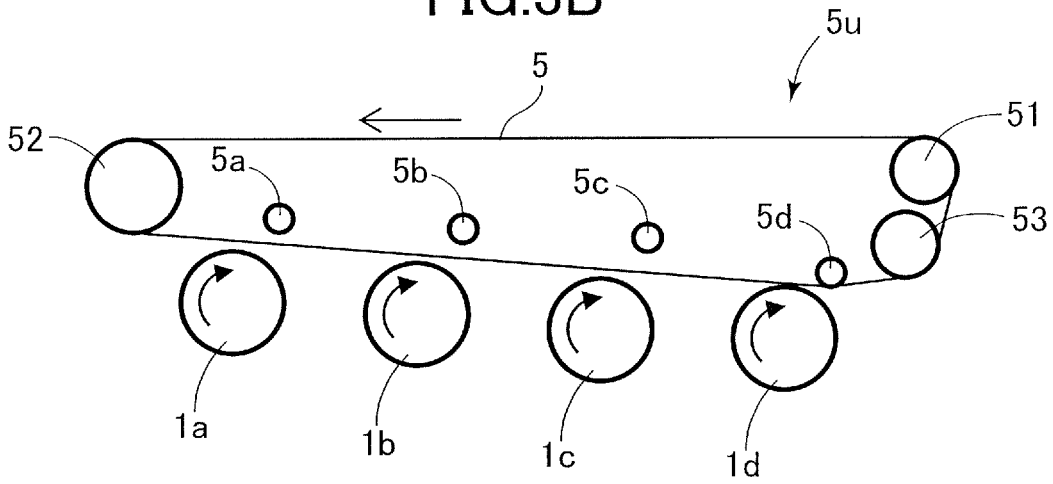
FIG. 3B is a frame format illustrating a transfer unit in a monochrome contact state.
Figure 3C:
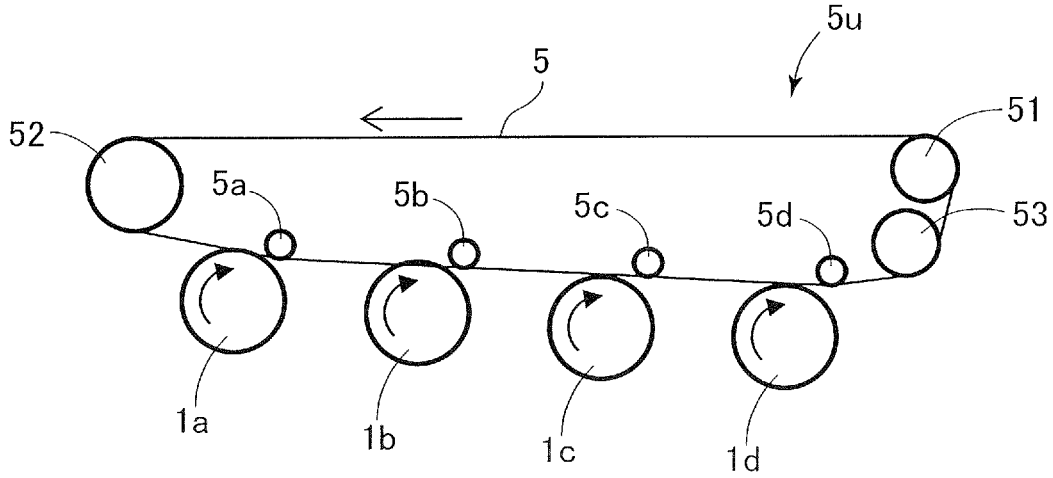
FIG. 3C is a frame format illustrating a transfer unit in a full-color contact state.

Next, the transfer unit 5*u* and a peripheral configuration thereof will be described. In the transfer unit 5*u*, as illustrated in FIGS. 3A through 3C, four primary transfer rollers 5*a*, 5*b*, 5*c* and 5*d* are configured to contact to or separate from the intermediate transfer belt 5. In the following description, a state in which all the primary transfer rollers 5*a*, 5*b*, 5*c* and 5*d* are separated from the intermediate transfer belt 5 is referred to as an all-separated state, as illustrated in FIG. 3A. If all the primary transfer rollers 5*a*, 5*b*, 5*c* and 5*d* are separated from the intermediate transfer belt 5, the intermediate transfer belt 5 is separated from the photosensitive drums 1*a*, 1*b*, 1*c* and 1*d* at positions corresponding to the primary transfer rollers 5*a*, 5*b*, 5*c* and 5*d*.

As illustrated in FIG. 3B, a state in which only the primary transfer roller 5*d* corresponding to black toner contacts the intermediate transfer belt 5 and the other primary transfer rollers 5*a*, 5*b* and 5*c* are separated from the intermediate transfer belt 5 is referred to as a monochrome contact state. Further, as illustrated in FIG. 3C, a state in which all the primary transfer rollers 5*a*, 5*b*, 5*c* and 5*d* are in contact with the intermediate transfer belt 5 is referred to as a full-color contact state.

The all-separated state is a mode in which the intermediate transfer belt 5 and the photosensitive drums 1*a* through 1*d* are separated to eliminate sliding friction during pre-rotation and post-rotation of printing operation, so as to reduce sliding friction resistance and prevent abrasion of sliding friction portion. The monochrome contact state is a mode in which a black toner image is primarily transferred from the photosensitive drum 1*d* to the intermediate transfer belt 5 during monochrome printing operation. Since photosensitive drums 1*a*, 1*b* and 1*c* which are not necessary for the printing operation are not in contact with the intermediate transfer belt 5, the rotation of the photosensitive drums 1*a*, 1*b* and 1*c* can be stopped, which saves energy and elongates the service life of the photosensitive drums 1*a*, 1*b* and 1*c*.

The full-color contact state is a mode in which the images on the photosensitive drums 1*a* through 1*d* are primarily transferred to the intermediate transfer belt 5 from all the photosensitive drums 1*a* through 1*d* during full color printing operation. As described, the transfer unit 5*u* is turned to the all-separated state, the monochrome contact state or the full-color contact state according to the print signal of the printer 10.

Figure 4A:
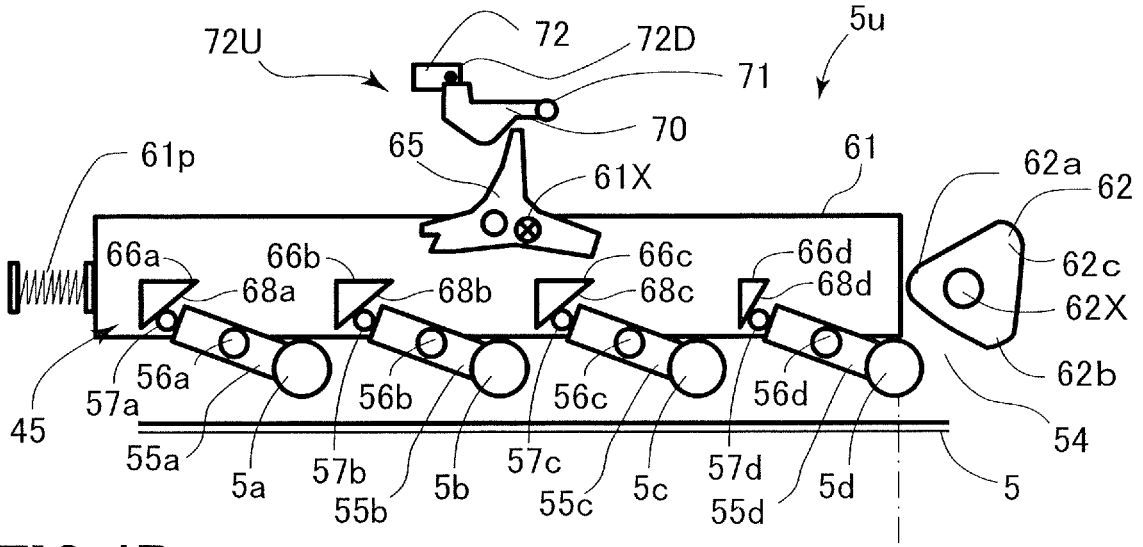
FIG. 4A is a view illustrating respective configurations of the transfer unit in the all-separated state.

Now, the configuration for turning the transfer unit 5*u* to the all-separated state, the monochrome contact state or the full-color contact state will be described. As illustrated in FIG. 4A, the transfer unit 5*u* includes a cam 62 rotatably supported on a transfer frame 54 serving as a unit body of the transfer unit 5*u*, and a slider 61 that moves in reciprocating motion by rotation of the cam 62.

Further, the transfer frame 54 rotatably supports transfer arms 55*a* through 55*d* around respective arm shafts 56*a* through 56*d*, and the primary transfer rollers 5*a*, 5*b*, 5*c* and 5*d* are respectively rotatably supported on one end of the transfer arms 55*a* through 55*d*. Shaft portions 57*a* through 57*d* are fixed to the other end of the transfer arms 55*a* through 55*d*. The transfer arms 55*a* through 55*d* are urged in a clockwise direction of FIG. 4A by a spring (not shown). That is, the primary transfer rollers 5*a*, 5*b*, 5*c* and 5*d* rotatably supported on the transfer arms 55*a* through 55*d* are urged toward a direction approaching the intermediate transfer belt 5.

The slider 61 serving as a first movement member is urged by a compression spring 61*p* to constantly contact the cam 62 and includes slope portions 66*a* through 66*d* capable of being in contact with the shaft portions 57*a* through 57*d*. The slope portions 66*a* through 66*c* have inclined surfaces 68*a* through 68*c*, and the sloped portion 66*d* has an inclined surface 68*d* whose angle is steeper with respect to a horizontal direction than the inclined surfaces 68*a* through 68*c*. The slope portions 66*a* through 66*c*, the transfer arms 55*a* through 55*d* and the shaft portions 57*a* through 57*d* constitute a contact/separation mechanism 45 that causes the primary transfer rollers 5*a*, 5*b*, 5*c* and 5*d* to contact or to separate from the intermediate transfer belt 5 according to the position of the slider 61.

The cam 62 is fixed to a cam shaft 62X so that it is rotatable around the cam shaft 62X, and the cam shaft 62X is designed to be rotated 120 degrees at a time and continuously by a drive control apparatus 217 described later. The cam 62 includes three operation surfaces 62*a* through 62*c* that respectively contact the slider 61 when the cam 62 is rotated 120 degrees at a time, and distance from the cam shaft 62X to the operation surfaces 62*a* through 62*c* is elongated in the named order. The slider 61 moves continuously in reciprocating motion through three stop positions when pressed by the operation surfaces 62*a* through 62*c*. That is, the cam 62 has a first rotation position, a second rotation position and a third rotation position in which each of the operation surfaces 62*a* through 62*c* contact the slider 61.

Figure 4B:
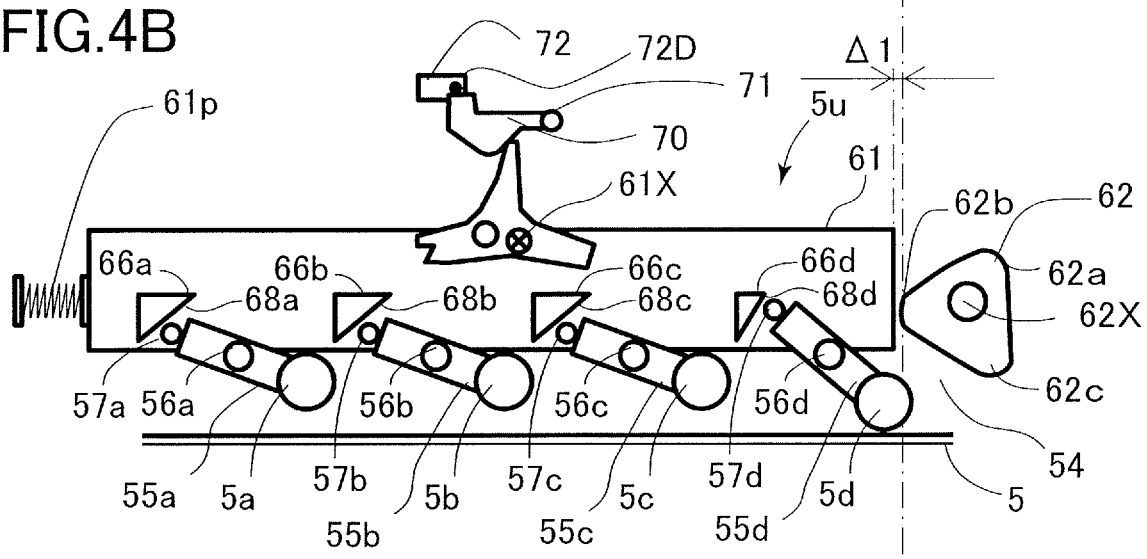
FIG. 4B is a view illustrating respective configurations of the transfer unit in the monochrome contact state.
Figure 4C:
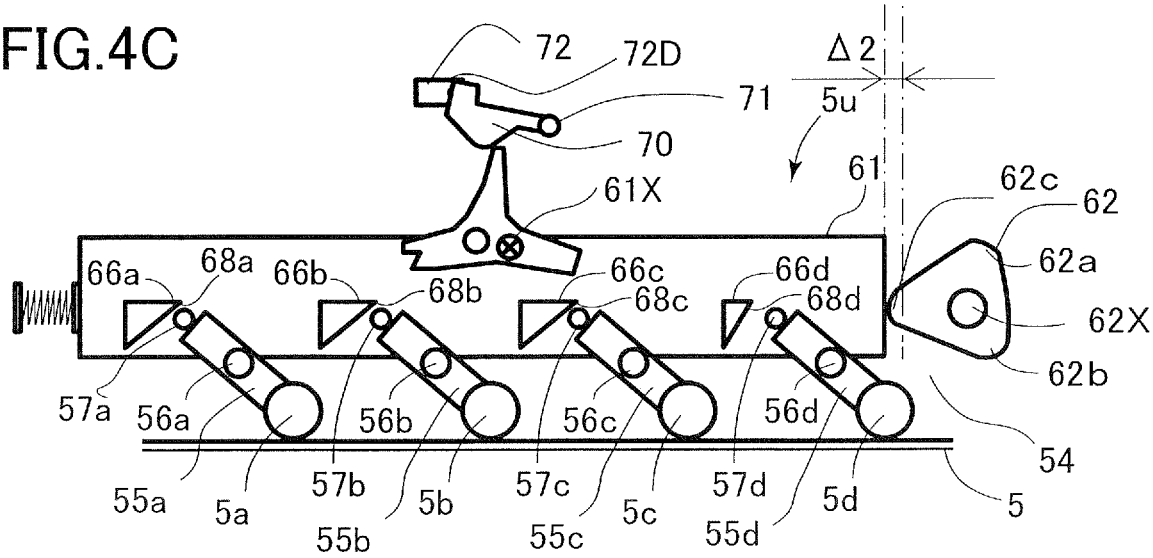
FIG. 4C is a view illustrating respective configurations of the transfer unit in the full-color contact state.

FIGS. 4A through 4C respectively correspond to the all-separated state, the monochrome contact state and the full-color contact state of the transfer unit 5*u*, and the position of the slider 61 in the all-separated state is set as a reference position. As illustrated in FIG. 4A, the slider 61 contacts the operation surface 62*a* of the cam 62, and in this state, the shaft portions 57*a* through 57*d* respectively fixed to the transfer arms 55*a* through 55*d* are retained by inclined surfaces 68*a* through 68*d* against an urging force of a spring (not shown). Then, the primary transfer rollers 5*a*, 5*b*, 5*c* and 5*d* are retained in a state separated from the intermediate transfer belt 5. That is, the transfer unit 5*u* is in the all-separated state.

As illustrated in FIG. 4B, in a state in which the cam 62 rotates clockwise for 120 degrees from the all-separated state, the operation surface 62*b* of the cam 62 contacts the slider 61, and the slider 61 moves in sliding motion for distance Δ1 from the reference position. In this state, the shaft portions 57*a* through 57*c* remain positioned by the inclined surfaces 68*a* through 68*c*, but the shaft portion 57*d* moves clockwise by a spring (not shown) while sliding against the inclined surface 68*c*. Thereby, a transfer arm 55*d* rotates clockwise, and the primary transfer roller 5*d* supported by the transfer arm 55*d* contacts the intermediate transfer belt 5. That is, the transfer unit 5*u* is in a monochrome contact state.

As illustrated in FIG. 4C, in a state in which the cam 62 rotates clockwise for 120 degrees from the monochrome contact state, the operation surface 62*c* of the cam 62 contacts the slider 61, and the slider 61 moves in sliding motion for distance Δ2 from the reference position. In this state, the shaft portions 57*a* through 57*c* also move clockwise by a spring (not shown) while sliding against the inclined surfaces 68*a* through 68*c*. Thereby, the transfer arms 55*a* through 55*d* rotate clockwise, and all the primary transfer rollers 5*a* through 5*d* contact the intermediate transfer belt 5. That is, the transfer unit 5*u* is in a full-color contact state.

Drive Control Apparatus

Figure 5A:
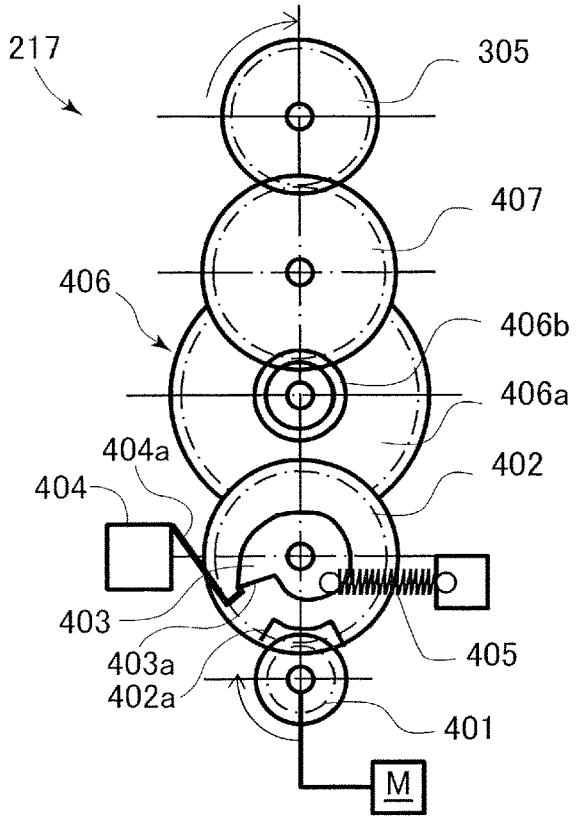
FIG. 5A is a front view illustrating a drive control apparatus.
Figure 5B:
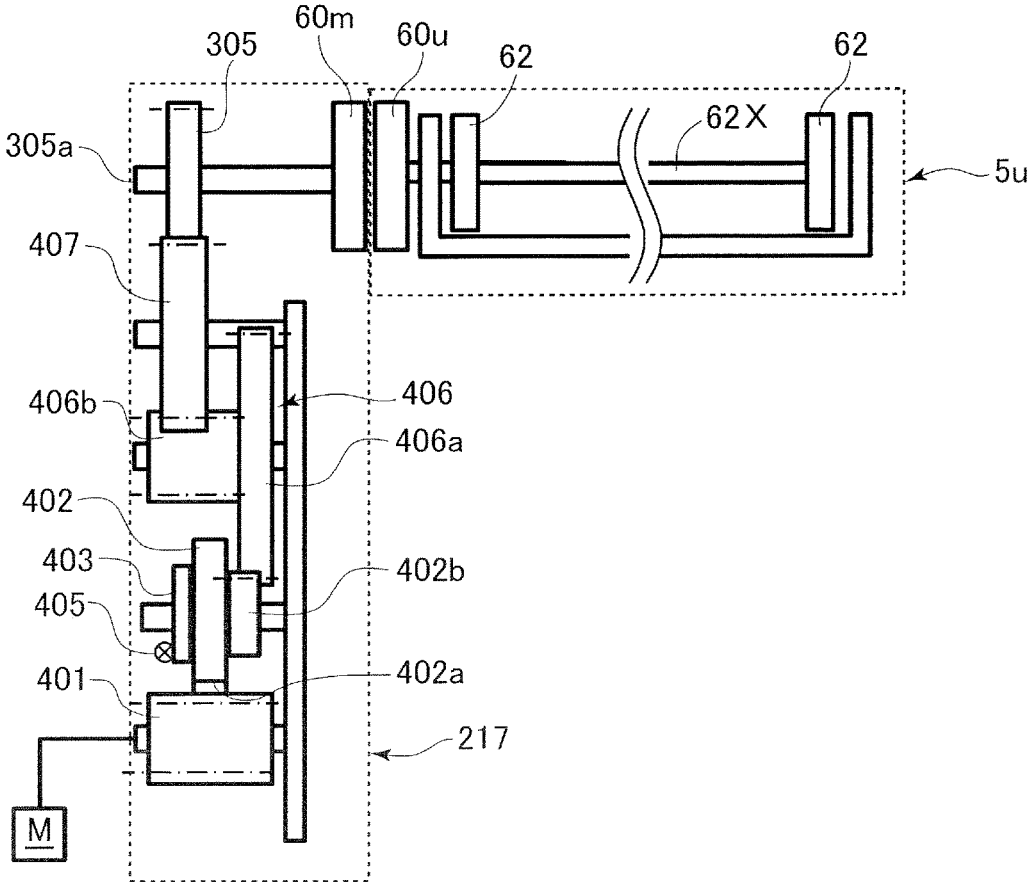
FIG. 5B is a side view illustrating the drive control apparatus and the transfer unit.

Next, the drive control apparatus 217 will be described with reference to FIGS. 5A and 5B. As illustrated in FIGS. 5A and 5B, the drive control apparatus 217 includes an input gear 401 that rotates in one direction by a motor M, a chipped tooth gear 402, a first gear 406, a second gear 407, and an output gear 305.

The chipped tooth gear 402 has a locking portion 403 fixed on one side and a side face gear portion 402*b* fixed on the other side in the axial direction, and in a state in which a locking surface 403*a* of the locking portion 403 is locked by a locking claw 404*a*, a chipped tooth portion 402*a* is opposed to the input gear 401. The locking claw 404*a* is capable of being in contact with and separating from the locking surface 403*a* by a solenoid 404, and in a state in which the locking claw 404*a* separates from the locking surface 403*a*, rotation of the chipped tooth gear 402 is displaced by a tension spring 405, and a geared portion engages with the input gear 401.

The side face gear portion 402*b* of the chipped tooth gear 402 is engaged with a large diameter gear 406*a* of the first gear 406, and the large diameter gear 406*a* is formed integrally with a small diameter gear 406*b*. The small diameter gear 406*b* is engaged with the second gear 407, and the second gear 407 is engaged with the output gear 305. A main body coupling 60*m* is provided on one end of a rotation shaft 305*a* of the output gear 305, and the main body coupling 60*m* is connected in a separable manner to a transfer coupling 60*u* provided on one end of the cam shaft 62X of the transfer unit 5*u*. There are two cams 62 described above provided on the cam shaft 62X at different positions in the axial direction.

In a gear train composed of the side face gear portion 402*b*, the first gear 406, the second gear 407 and the output gear 305, the number of teeth is set so that a reduction ratio of 3:1 is realized. Therefore, while the chipped tooth gear 402 rotates once, drive force is transmitted through the main body coupling 60*m* and the transfer coupling 60*u* so that the cam shaft 62X only rotates for 120 degrees. Therefore, the cam 62 fixed to the cam shaft 62X can be continuously rotated for 120 degrees corresponding to the number of times the solenoid 404 is operated, by which the transfer unit 5*u* can be turned to the all-separated state, the monochrome contact state and the full-color contact state.

Detection Mechanism

Next, a detection mechanism of the printer 10 will be described. In the present embodiment, the detection mechanism is configured to perform old/new detection for detecting whether the transfer unit 5*u* is old or new, a contact state detection of the primary transfer roller and a type detection of the transfer unit 5*u*, but the present invention is not restricted to this configuration, and the detection mechanism of the present embodiment can be used for other purposes.

Figure 6A:
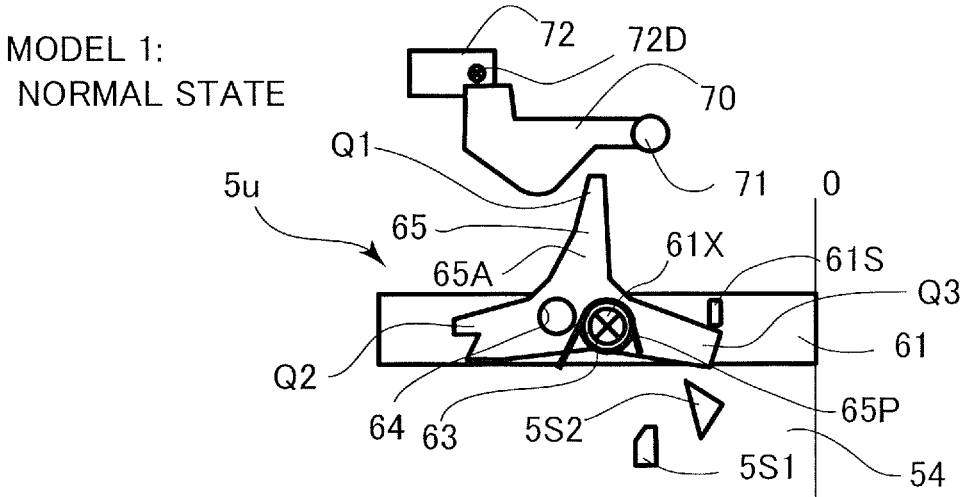
FIG. 6A is a view illustrating an all-separated state of a model 1 transfer unit in a normal state.

As illustrated in FIG. 6A, a photosensor 72 and a flag member 70 are provided in the printer body 10A (refer to FIG. 2A). The photosensor 72 can be turned to a light shielded state serving as a first state and a light transmitted state serving as a second state. The flag member 70 turns the photosensor 72 to the light shielded state or the light transmitted state. The flag member 70 is pivotably supported on a transfer frame 54 around a rotary shaft 71, and the flag member 70 sets the photosensor 72 to a light shielded state by shielding an optical path 72D of the photosensor 72 and sets the photosensor 72 to a light transmitted state by opening the optical path 72D. The photosensor 72 outputs different detection signals according to each of the light shielded state and the light transmitted state.

As illustrated in FIG. 6A, the flag member 70 is retained so that the photosensor 72 is set to the light transmitted state by a spring (not shown), its own weight of the flag member 70 or a stopper (not shown). The photosensor 72 and the flag member 70 constitute a sensor unit 72U (refer to FIG. 4A) serving as a detection portion.

Further, the slider 61 has a shaft portion 61X that extends in a direction orthogonal to a direction of movement of the slider 61, and a detection lever 65 serving as a second movement member is rotatably supported on the shaft portion 61X. That is, the detection lever 65 rotates with the shaft portion 61X serving as a center of rotation. Further, the slider 61 moves in reciprocating motion in a direction orthogonal to the axial direction of the shaft portion 61X by the cam 62 rotating in a state being in contact with the slider 61. The detection lever 65 includes a first hole portion 63 and a second hole portion 64 that are engageable with the shaft portion 61X, and in FIGS. 6A through 6C, the shaft portion 61X is engaged with the first hole portion 63. The detection lever 65 is composed of a plate-like member and has a first surface 65A and a second surface 65B (refer to FIG. 10A) in the axial direction of the shaft portion 61X.

Figure 10A:
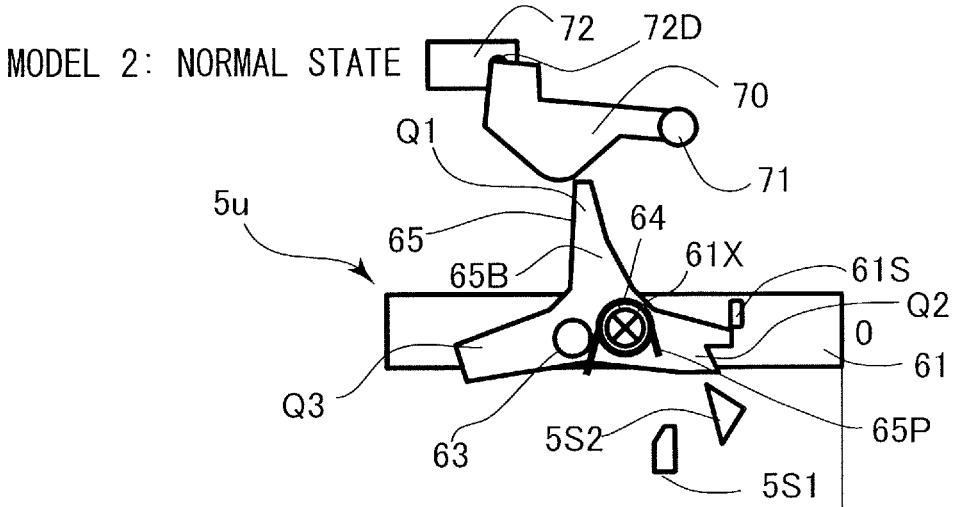
FIG. 10A is a view illustrating an all-separated state of a model 2 transfer unit in a normal state.

Then, as illustrated in FIG. 6A, if the detection lever 65 is to be attached with the first surface 65A arranged at the surface, the shaft portion 61X is engaged with the first hole portion 63, and if the detection lever 65 is to be attached with the second surface 65B arranged at the surface, the shaft portion 61X is engaged with the second hole portion 64, as illustrated in FIG. 10A. As described, the detection lever 65 is attachable to the shaft portion 61X of the slider 61 in normal and reversed states, and in the following description, a manner where the first surface 65A is arranged at a front surface is called a first manner, and a manner where the second surface 65B is arranged at the front surface is called a second manner. Further, the transfer unit 5*u* having the detection lever 65 attached in the first manner is called model 1, and the transfer unit 5*u* having the detection lever 65 attached in the second manner is called model 2.

The detection lever 65 attached to the slider 61 in the first manner is urged counterclockwise by a detection lever spring 65P serving as an urging portion wound around the shaft portion 61X, as illustrated in FIG. 6A. The slider 61 includes a contact portion 61S serving as a first contact portion that contacts the detection lever 65 urged by the detection lever spring 65P and positions the detection lever 65 with respect to the slider 61. In the following description, a state in which the detection lever 65 contacts the contact portion 61S is referred to as a normal state.

Now, the detection lever 65 includes a first protruded portion Q1, a second protruded portion Q2 and a third protruded portion Q3 that respectively extend in radial directions away from the shaft portion 61X. As illustrated in FIG. 6A, the detection lever 65 of the model 1 transfer unit 5*u* is capable of being in contact with the contact portion 61S and a first stopper 5S1 by the third protruded portion Q3. Further, as illustrated in FIG. 10A, the detection lever 65 of the model 2 transfer unit 5*u* is capable of being in contact with the contact portion 61S and a second stopper 5S2 described later. In both model 1 and model 2, the first protruded portion Q1 is configured to press the flag member 70.

Figure 6B:
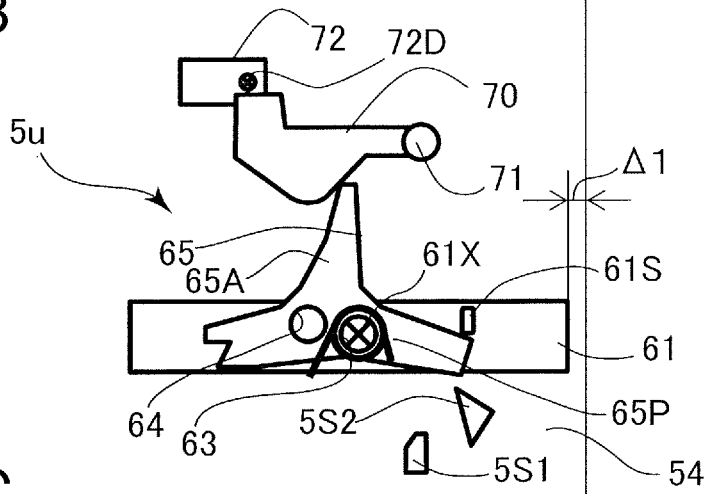
FIG. 6B is a view illustrating a monochrome contact state of the same.
Figure 6C:
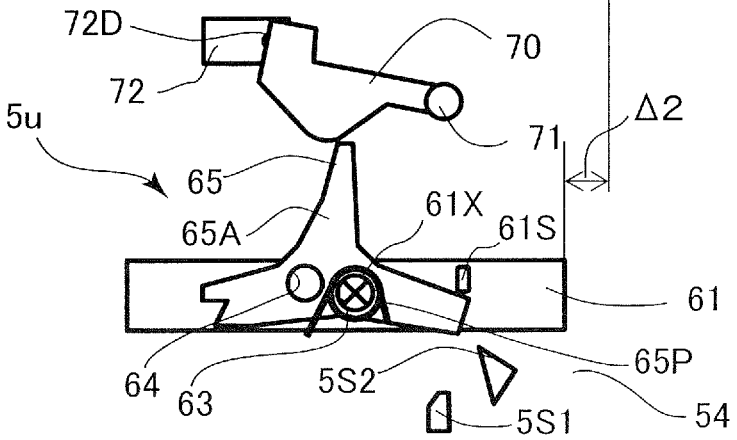
FIG. 6C is a view illustrating a full-color contact state of the same.

FIGS. 6A through 6C are views illustrating the all-separated state, the monochrome contact state and the full-color contact state of the model 1 transfer unit 5*u* in the normal state. Further, FIGS. 7A through 7C are states of detection of the photosensor 72 in the respective states illustrated in FIGS. 6A through 6C.

Figure 7A:
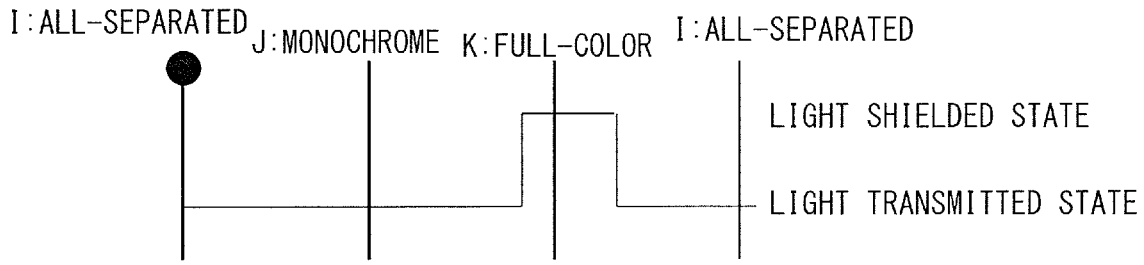
FIG. 7A is a view illustrating a detection pattern of a photosensor according to the all-separated state of a model 1 transfer unit in the normal state.
Figure 7B:
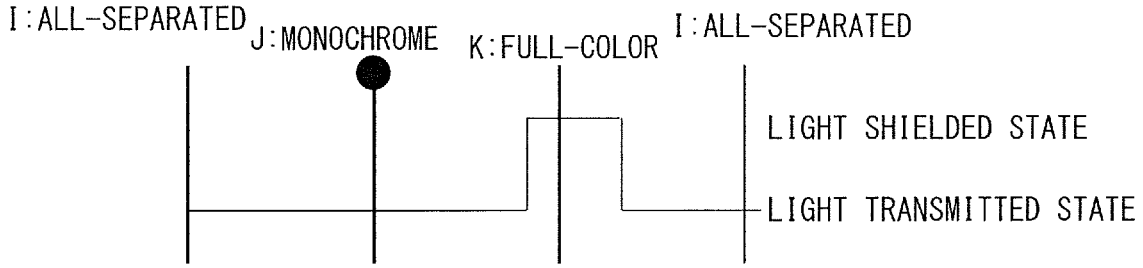
FIG. 7B is a view illustrating a detection pattern of the photosensor according to the monochrome contact state of the same.
Figure 7C:
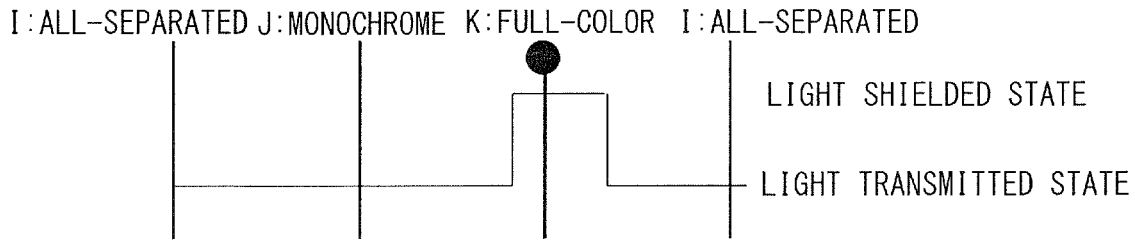
FIG. 7C is a view illustrating a detection pattern of the photosensor according to the full-color contact state of the same.

As illustrated in FIG. 6A, if the model 1 transfer unit 5*u* in the normal state is in the all-separated state, the detection lever 65 is separated from the flag member 70, and the photosensor 72 is in the light transmitted state, as illustrated in FIG. 7A.

As illustrated in FIG. 6B, if the transfer unit 5*u* is turned from the all-separated state to the monochrome contact state by having the cam 62 rotate for 120 degrees, the slider 61 moves in sliding motion for distance Δ1 from a reference position (0). Thereby, a relative position of the detection lever 65 supported on the slider 61 with respect to the flag member 70 is changed. Specifically, the detection lever 65 starts to contact the flag member 70. In this state, the detection lever 65 still opens the optical path 72D of the flag member 70, and the photosensor 72 is in a light transmitted state, as illustrated in FIG. 7B.

Then, as illustrated in FIG. 6C, if the transfer unit 5*u* is turned from the monochrome contact state to the full-color contact state by having the cam 62 rotate further for 120 degrees, the slider 61 stops at a position after moving in sliding motion for distance Δ2 from the reference position (0). Thereby, the flag member 70 is pushed upward by the detection lever 65 and the flag member 70 shades the optical path 72D of the photosensor 72. Therefore, the photosensor 72 is in the light shielded state, as illustrated in FIG. 7C. These three states are repeated in a reciprocating motion by the rotation of the cam 62.

Next, we will describe a detection pattern of the photosensor 72 in the model 1 transfer unit 5*u* in a new state. FIGS. 8A through 8D respectively illustrate the all-separated state, the monochrome contact state, a state during transition from the monochrome contact state to the full-color contact state and the full-color contact state of the model 1 transfer unit 5*u* in a new state. Further, FIGS. 9A through 9D illustrate states of detection of the photosensor 72 in the respective states illustrated in FIGS. 8A through 8D.

Figure 8A:
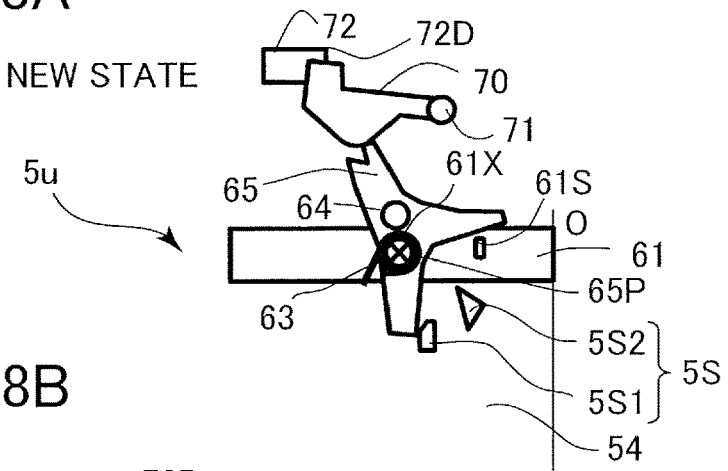
FIG. 8A is a view illustrating an all-separated state of a model 1 transfer unit in a new state.

As illustrated in FIG. 8A, the first stopper 5S1 and the second stopper 5S2 are provided on the transfer frame 54, wherein the first and second stoppers 5S1 and 5S2 constitute a second contact portion 5S. The detection lever 65 of the model 1 transfer unit 5*u* in the new state is positioned by being in contact with the first stopper 5S1 and in the all-separated state in the initial state.

Figure 9A:
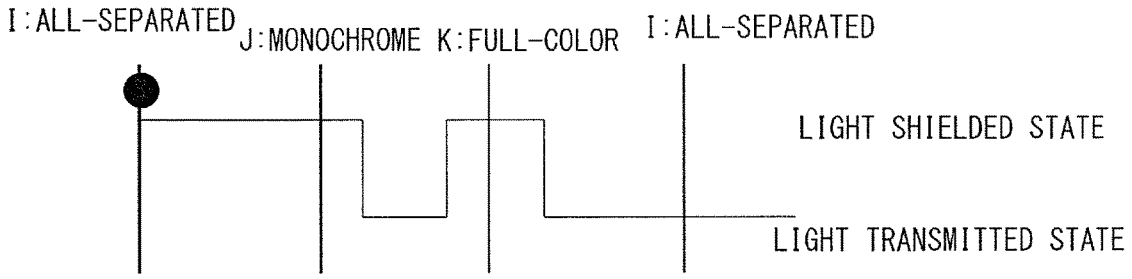
FIG. 9A is a view illustrating a detection pattern of a photosensor according to an all-separated state of the model 1 transfer unit in the normal state.

As illustrated in FIG. 8A, if the model 1 transfer unit 5*u* in the new state is in the all-separated state, the flag member 70 is pushed upward by the detection lever 65, and the flag member 70 blocks the optical path 72D of the photosensor 72. Therefore, the photosensor 72 is in the light shielded state, as illustrated in FIG. 9A. In this state, the slider 61 is positioned at a same position as the reference position (0) illustrated in FIG. 6A.

Figure 8B:
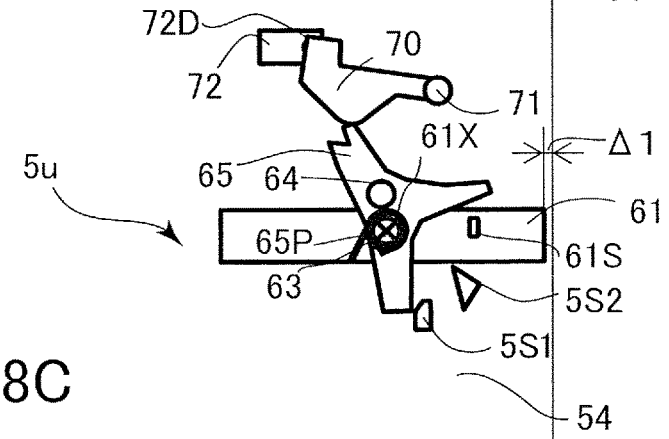
FIG. 8B is a view illustrating a monochrome contact state of the same.
Figure 9B:
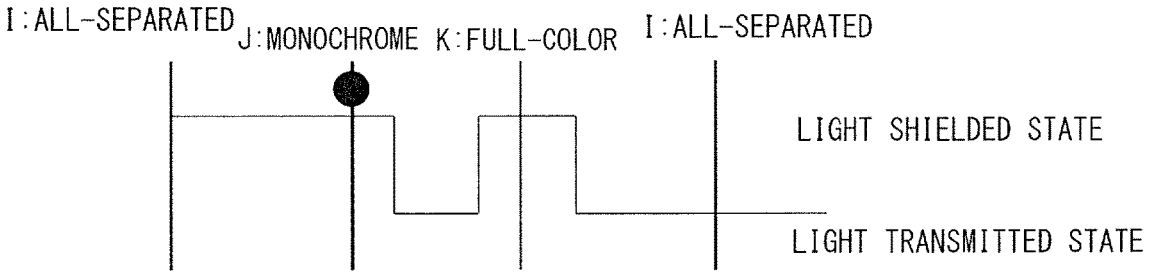
FIG. 9B is a view illustrating a detection pattern of the photosensor according to a monochrome contact state of the same.

As illustrated in FIG. 8B, if the transfer unit 5*u* is turned from the all-separated state to the monochrome contact state by having the cam 62 rotate for 120 degrees, the slider 61 moves in sliding motion for distance Δ1 from the reference position (0). In this state, the detection lever 65 maintains contact with the first stopper 5S1. The photosensor 72 is in the light shielded state, as illustrated in FIG. 9B.

Figure 8C:
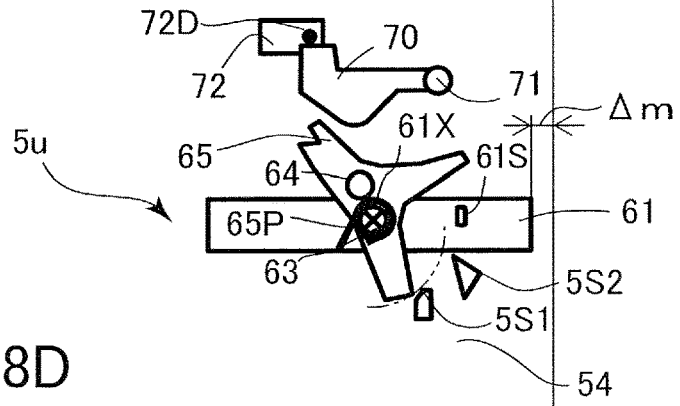
FIG. 8C is a view illustrating a state during transition from the monochrome contact state to a full-color contact state of the same.
Figure 9C:
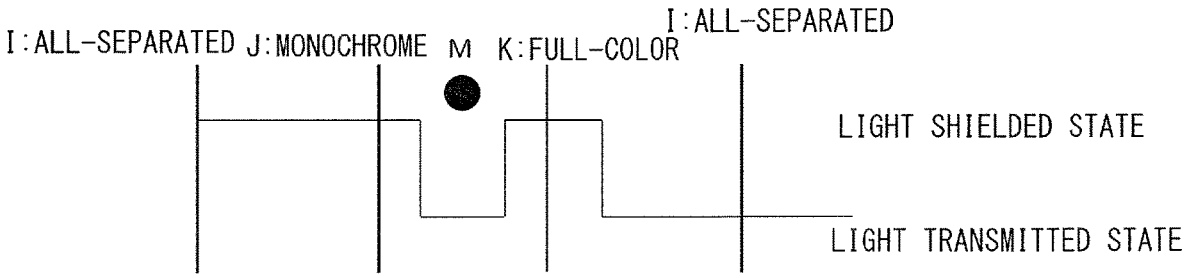
FIG. 9C is a view illustrating a detection pattern of the photosensor during transition from the monochrome contact state to the full-color contact state of the same.

FIG. 8C illustrates a state during transition from the monochrome contact state to the full-color contact state, in which the slider 61 is slid for distance Δm from the reference position (0). In this state, the detection lever 65 is released from the first stopper 5S1 and starts to rotate in a counterclockwise direction by urging force of the detection lever spring 65P. In a state in which the detection lever 65 rotates in the counterclockwise direction, the detection lever 65 temporarily separates from the flag member 70, such that the photosensor 72 is in a light transmitted state, as shown in FIG. 9C. Thereafter, the detection lever 65 contacts the contact portion 61S and will be in a normal state.

Figure 8D:
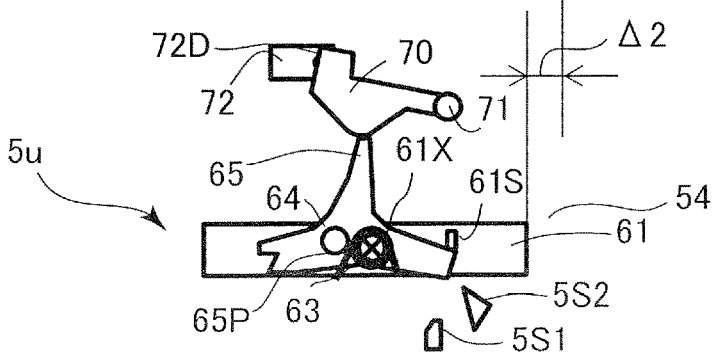
FIG. 8D is a view illustrating a full-color contact state of the same.
Figure 9D:
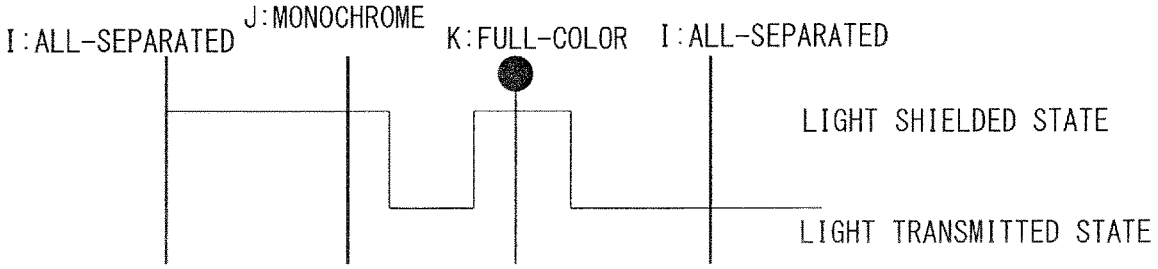
FIG. 9D is a view illustrating a detection pattern of the photosensor according to a full-color contact state of the same.

As illustrated in FIG. 8D, if the cam 62 further rotates for 120 degrees from the monochrome contact state to the full-color contact state, the slider 61 slides for distance Δ2 from the reference position (0) and stops. In this state, the flag member 70 is pushed upward by the detection lever 65 in the normal state, and it will be in a state similar to FIG. 6C. Therefore, the photosensor 72 is in a light shielded state, as illustrated in FIG. 9D. Thereafter, the detection lever 65 will stay in the normal state where it is in contact with the contact portion 61S, so that the three states illustrated in FIGS. 6A through 6C are repeatedly performed in reciprocating motion by the rotation of the cam 62.

Figure 10B:
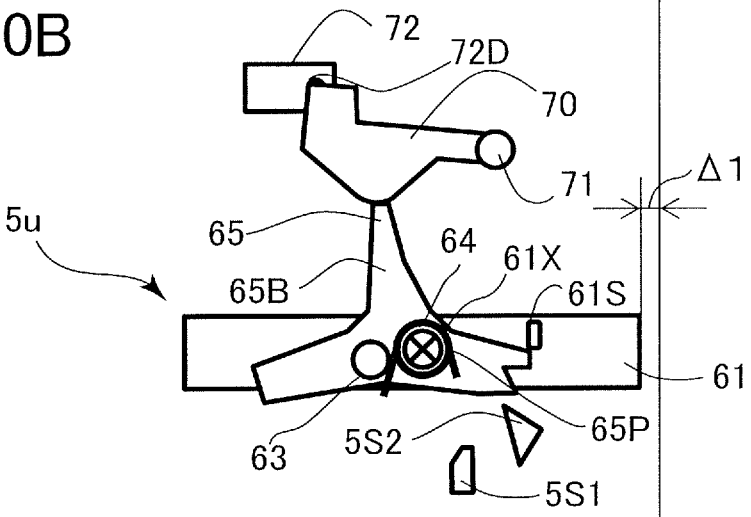
FIG. 10B is a view illustrating a monochrome contact state of the same.
Figure 10C:
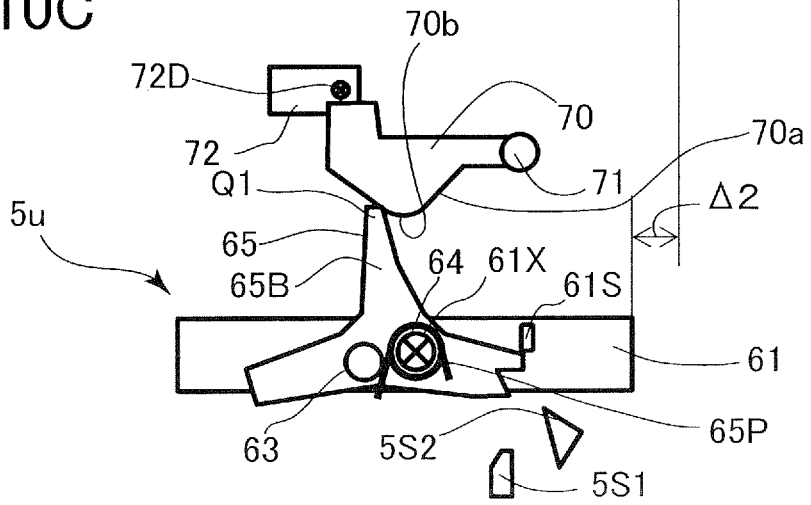
FIG. 10C is a view illustrating a full-color contact state of the same.

Next, the detection pattern of a model 2 photosensor 72 in a normal state and a new state will be described. FIGS. 10A through 10C respectively illustrate an all-separated state, a monochrome contact state and a full-color contact state of the model 2 transfer unit 5*u* in a normal state. Further, FIGS. 11A through 11C illustrate states of detection of the photosensor 72 corresponding to the respective states of FIGS. 10A through 10C.

Figure 11A:
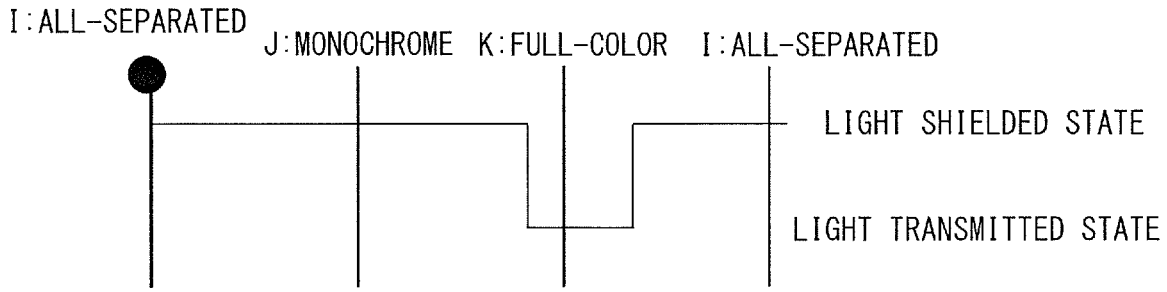
FIG. 11A is a view illustrating a detection pattern of a photosensor according to an all-separated state of the model 2 transfer unit in the normal state.
Figure 11B:
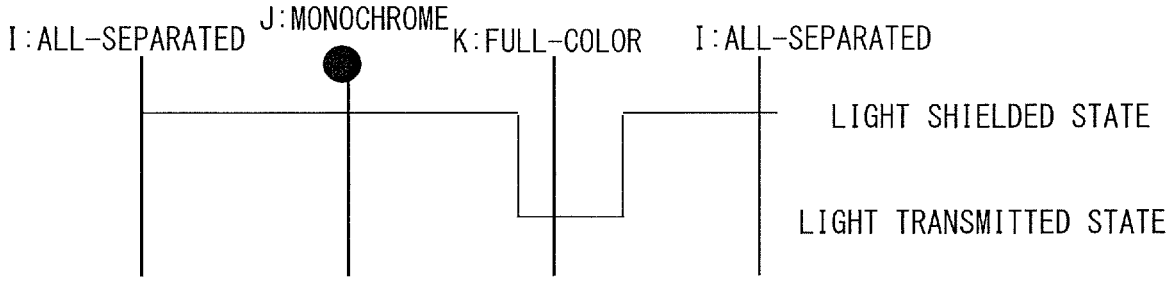
FIG. 11B is a view illustrating a detection pattern of the photosensor according to a monochrome contact state of the same.
Figure 11C:
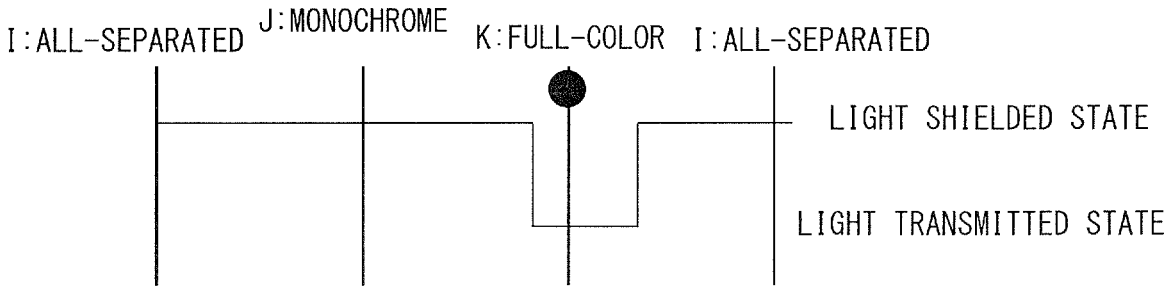
FIG. 11C is a view illustrating a detection pattern of the photosensor according to a full-color contact state of the same.

As illustrated in FIG. 10A, if the model 2 transfer unit 5*u* in the normal state is in the all-separated state, the detection lever 65 pushes the flag member 70 upward, and the photosensor 72 is in a light shielded state, as illustrated in FIG. 11A.

As illustrated in FIG. 10B, if the transfer unit 5*u* is turned from the all-separated state to the monochrome contact state by having the cam 62 rotate for 120 degrees, the slider 61 moves in sliding motion for distance Δ1 from the reference position (0). Thereby, a relative position of the detection lever 65 supported on the slider 61 with respect to the flag member 70 is changed. In this state, the detection lever 65 still blocks the optical path 72D of the flag member 70, and the photosensor 72 is in a light shielded state, as illustrated in FIG. 11B.

Then, as illustrated in FIG. 10C, if the transfer unit 5*u* is turned from the monochrome contact state to the full-color contact state by having cam 62 further rotate for 120 degrees, the slider 61 stops at a position after moving in sliding motion for distance Δ2 from the reference position (0). In this state, the first protruded portion Q1 of the detection lever 65 passes an apex portion 70*b* of an operation surface 70*a* of the flag member 70. Therefore, the flag member 70 is lowered, and the flag member 70 opens the optical path 72D of the photosensor 72. Thus, the photosensor 72 is in a light transmitted state, as illustrated in FIG. 11C. These three states will be repeated in reciprocating motion by the rotation of the cam 62.

Next, detection patterns of the photosensor 72 of the model 2 transfer unit 5*u* in a new state will be described. FIGS. 12A through 12D respectively illustrate the all-separated state, the monochrome contact state, a state during transition from the monochrome contact state to the full-color contact state and the full-color contact state of the model 2 transfer unit 5*u* in a new state. Further, FIGS. 13A through 13D illustrate states of detection of the photosensor 72 in the respective states illustrated in FIGS. 12A through 12D.

Figure 12A:
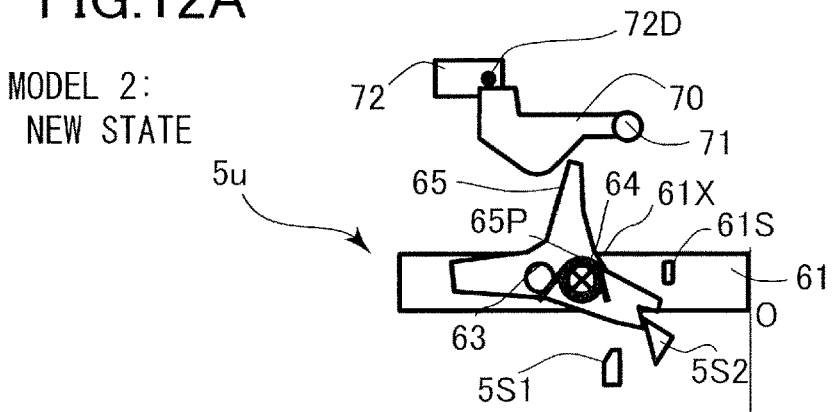
FIG. 12A is a view illustrating an all-separated state of a model 2 transfer unit in a new state.

As illustrated in FIG. 12A, the detection lever 65 of the model 2 transfer unit 5*u* in the new state is positioned by being in contact with the second stopper 5S2 and in the all-separated state in the initial state.

Figure 13A:
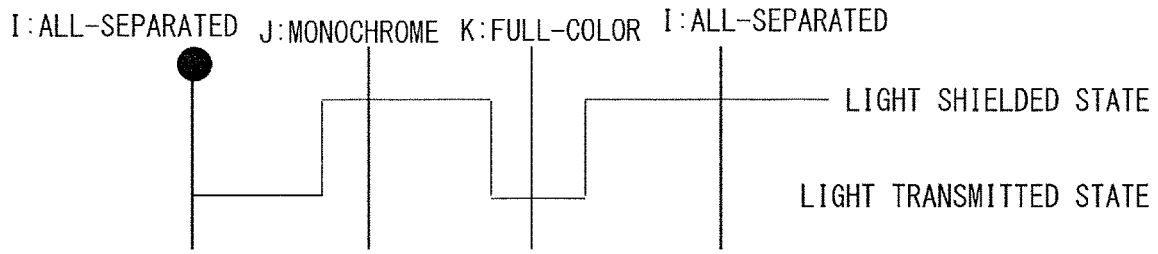
FIG. 13A is a view illustrating a detection pattern of a photosensor according to an all-separated state of the model 2 transfer unit in the new state.
Figure 13B:
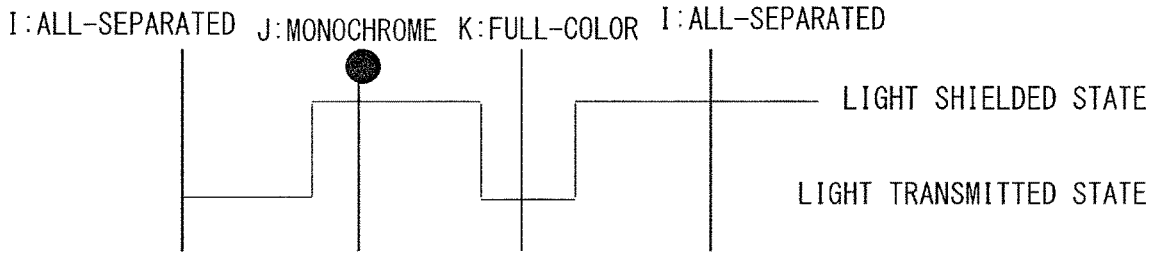
FIG. 13B is a view illustrating a detection pattern of the photosensor according to a monochrome contact state of the same.

As illustrated in FIG. 12A, if the model 2 transfer unit 5*u* in the new state is in the all-separated state, the detection lever 65 is separated from the flag member 70, and the photosensor 72 is in a light transmitted state, as illustrated in FIG. 13A. In this state, the slider 61 is positioned at a same position as the reference position (0) illustrated in FIG. 11A.

Figure 12B:
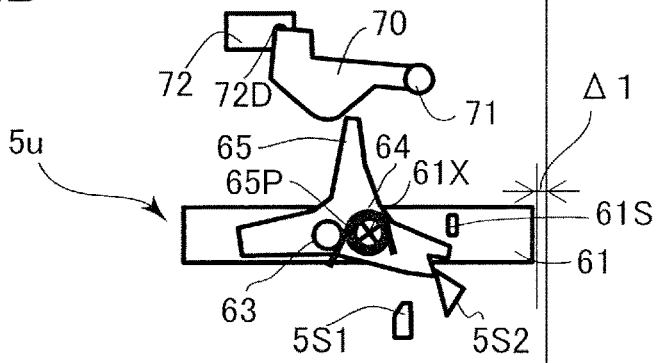
FIG. 12B is a view illustrating a monochrome contact state of the same.

As illustrated in FIG. 12B, if the transfer unit 5*u* is turned from the all-separated state to the monochrome contact state by having the cam 62 rotate for 120 degrees, the slider 61 moves in sliding motion for distance Δ1 from the reference position (0). In this state, the detection lever 65 maintains contact with the second stopper 5S2. Then, the flag member 70 is pushed upward by the detection lever 65, and the flag member 70 blocks the optical path 72D of the photosensor 72. Therefore, the photosensor 72 is in a light shielded state, as illustrated in FIG. 13A.

Figure 12C:
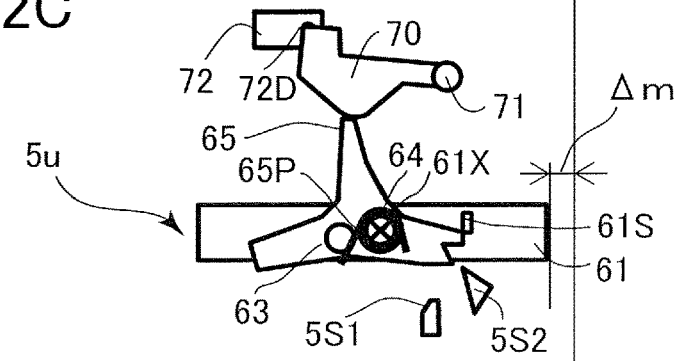
FIG. 12C is a view illustrating a state during transition from the monochrome contact state to the full-color contact state of the same.
Figure 13C:
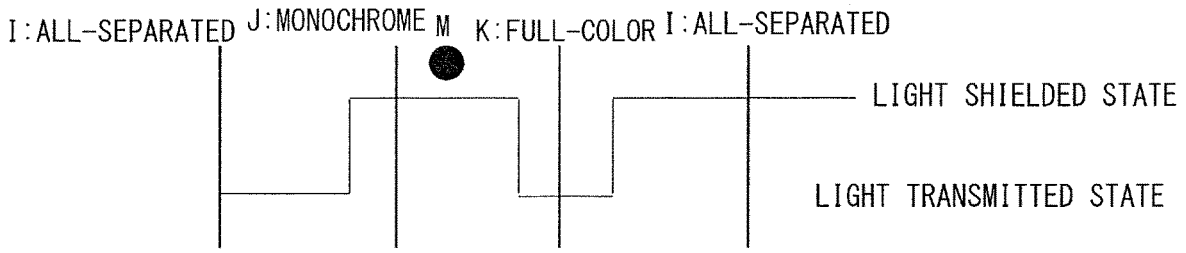
FIG. 13C is a view illustrating a detection pattern of the photosensor according to a state during transition from the monochrome contact state to a full-color contact state of the same.

FIG. 12C illustrates a state during transition from the monochrome contact state to the full-color contact state, where the slider 61 is slid for distance Δm from the reference position (0). In this state, the detection lever 65 is released from the second stopper 5S2 and starts to rotate in a counterclockwise direction by urging force of the detection lever spring 65P. In a state in which the detection lever 65 rotates in the counterclockwise direction, the flag member 70 will not move much, such that the photosensor 72 maintains the light shielded state, as shown in FIG. 13C. Thereafter, the detection lever 65 contacts the contact portion 61S and will be in a normal state. Therefore, in either model 1 or model 2, while the cam 62 rotates once, the detection lever 65 is separated from the first stopper 5S1 or the second stopper 5S2 and positioned at the contact portion 61S by the urging force of the detection lever spring 65P.

Figure 12D:
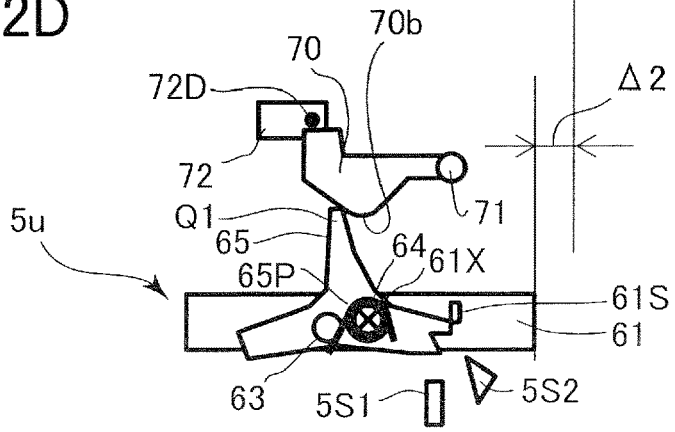
FIG. 12D is a view illustrating a full-color contact state of the same.
Figure 13D:
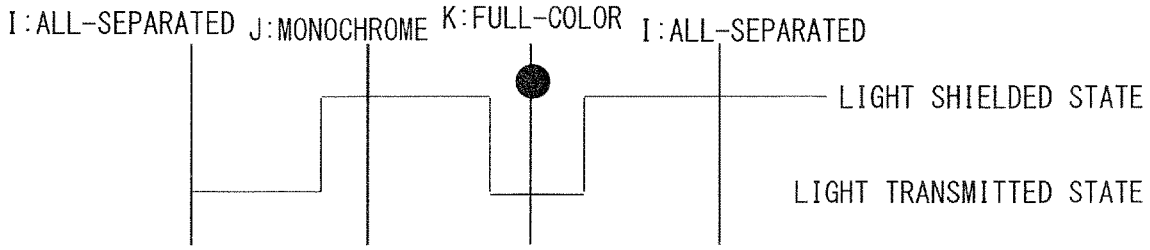
FIG. 13D is a view illustrating a detection pattern of the photosensor according to a full-color contact state of the same.

As illustrated in FIG. 12D, if the cam 62 further rotates for 120 degrees from the monochrome contact state to the full-color contact state, the slider 61 moves in sliding motion for distance Δ2 from the reference position (0) and stops. In this state, the flag member 70 is pushed upward by the detection lever 65 in the normal state, and it will be in a state similar to FIG. 10C. Therefore, the photosensor 72 will be in a light transmitted state, as illustrated in FIG. 13D. Thereafter, the detection lever 65 will maintain the normal state where it is in contact with the contact portion 61S, so that the three states illustrated in FIGS. 10A through 10C will be repeatedly performed in reciprocating motion by the rotation of the cam 62.

Control Block

Figure 14:
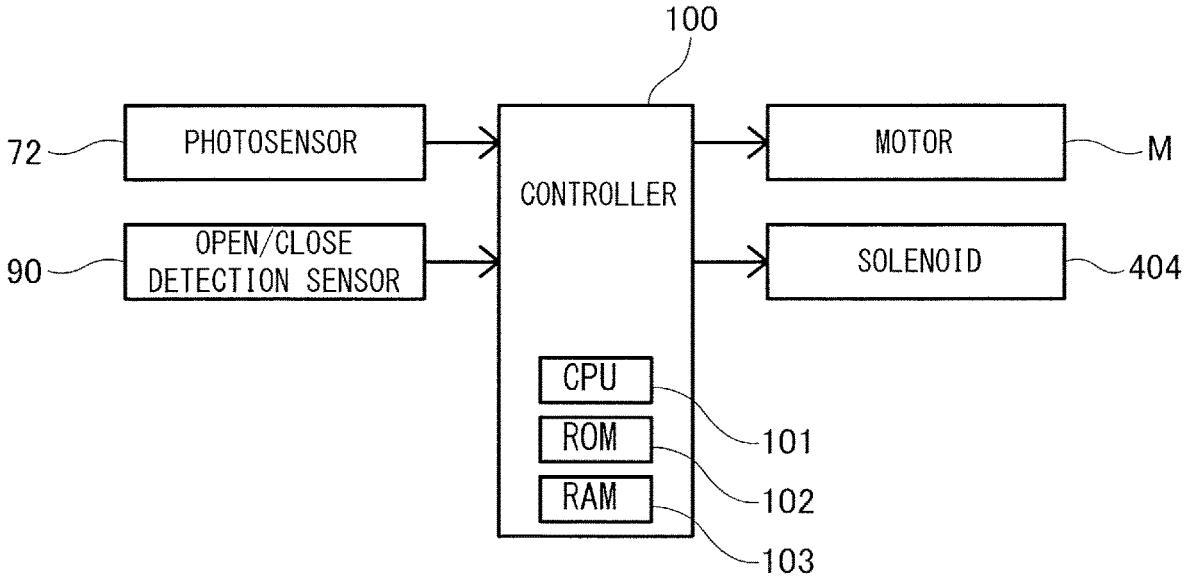
FIG. 14 is a control block diagram according to a first embodiment.

FIG. 14 illustrates a control block diagram according to the present embodiment. A controller 100 provided on the printer 10 includes a CPU 101 serving as a computing device, a ROM 102 storing various programs, a RAM 103 used as region for temporarily storing control data or an operation region for arithmetic operation, and so on. Further, the ROM 102 stores information of respective detection patterns of the model 1 and model 2 photosensor 72 and in the normal state and new state.

A photosensor 72 and an open/close detection sensor 90 for detecting opening and closing of the right door Rd (refer to FIG. 2A) are connected to an input side of the controller 100. The turning of the open/close detection sensor 90 from off to on enables to detect that the right door Rd has been closed on the printer body 10A. The motor M and the solenoid 404 are connected to an output side of the controller 100.

Initial Control of Attachment

Figure 15:
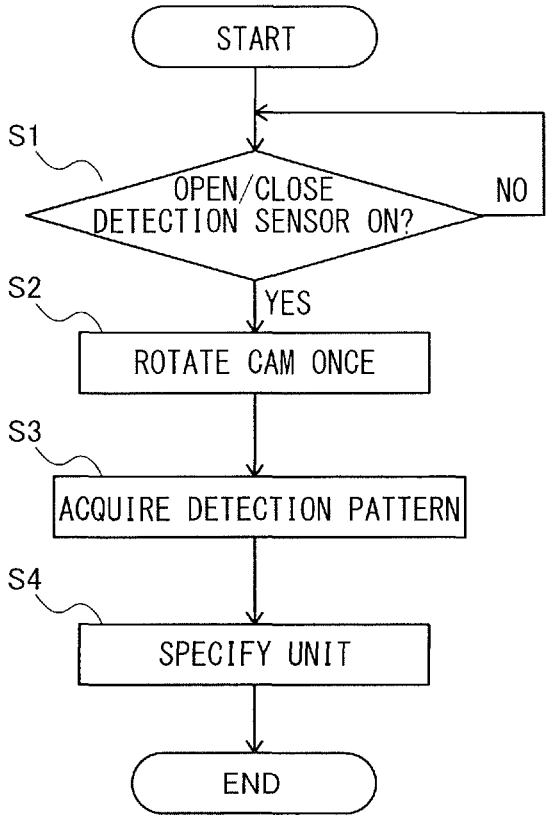
FIG. 15 is a flowchart describing an initial control.

Next, an initial control performed when the transfer unit 5*u* is attached to the printer body 10A will be described with reference to FIG. 15. If the user wishes to replace the transfer unit 5*u*, at first, the user opens the right door Rd to replace the transfer unit 5*u* with a new one, and then closes the right door Rd. The controller 100 determines whether the open/close detection sensor 90 has been turned from off to on (step S1).

If the open/close detection sensor 90 is turned from off to on (step S1: YES), the controller 100 determines that replacement of the transfer unit 5*u* has been completed, and operates the solenoid 404 three times at predetermined intervals while driving the motor M. Thereby, the cam 62 is rotated once as described earlier, the transfer unit 5*u* turns from the all-separated state to the monochrome contact state and the full-color contact state, and returns to the all-separated state (step S2).

Then, the controller 100 acquires the detection pattern of the photosensor 72 while the cam 62 rotates once and stores the same in the RAM 103 (step S3). Next, the controller 100 compares detection patterns stored in advance in the ROM 102 and the detection pattern acquired in step S3 and performs old/new detection and type (model) detection of the transfer unit 5*u* that has been attached newly, thereby specifying the unit (step S4). That is, the controller 100 discriminates the type of the transfer unit 5*u* attached to the printer body 10A and whether the unit 5*u* is old or new.

Based on the above operation, initial control of a state in which the transfer unit 5*u* is attached is completed. By completing the initial control, the model 1 or model 2 transfer unit 5*u* attached in a new state will be in a normal state where the detection lever 65 contacts the contact portion 61S. Further, in a state in which the initial control is completed, it may be possible to reset a counter for counting the number of rotations of the transfer unit 5*u* to detect service life of the transfer unit 5*u*. Thereby, the user or service technician will not be required to reset the use history manually, and the counter can be reset infallibly by omitting manual operation.

Even after completing the present initial control, the controller 100 acquires the detection pattern of the photosensor 72, and it can detect whether the transfer unit 5*u* is in the all-separated state, the monochrome contact state or the full-color contact state.

As described above, according to the present embodiment, a plurality of different detection patterns can be created using the photosensor 72 for detecting the contact/separation states, i.e., the all-separated state, the monochrome contact state and the full-color contact state, of the transfer unit 5*u*. Thereby, old/new detection and type detection of the transfer unit 5*u* can be performed. Even after completing initial control of the transfer unit 5*u*, the photosensor 72 is used for detecting the contact state of the transfer unit 5*u*, and there is no need to additionally provide a dedicated sensor for performing old/new detection or type detection of the transfer unit 5*u*. According to the present embodiment, costs can be cut down. Further, type detection can be performed by simply varying the assembling manner of the detection lever 65, so that the components can be used in common and costs can be cut down.

The transfer unit 5*u* can be divided into a high durability unit capable of reducing the replacement frequency and a low-cost unit that has shorter service life but can be introduced easily, which can be selected according to the frequency of use of the apparatus by the user, for example, and these types can be applied to the above-described models 1 and 2.

According to the present embodiment, a first stopper 5S1 and a second stopper 5S2 respectively capable of being in contact with model 1 and model 2 transfer units in a new state are provided, but the stoppers are not restricted thereto. That is, it may be possible to provide one stopper capable of being in contact with both model 1 and model 2 transfer units in a new state, while having the shape of the detection lever 65 changed so that the detection patterns are varied between model 1 and model 2 transfer units.

Further according to the present embodiment, the detection patterns of the photosensor 72 are varied among the normal state of model 1, new state of model 1, normal state of model 2 and new state of model 2, but the present invention is not restricted thereto. For example, the detection pattern of the photosensor 72 can be the same for the normal state of model 1 and normal state of model 2.

Second Embodiment

Next, a second embodiment of the present invention will be described. In the second embodiment, a switch is provided instead of the photosensor 72 of the first embodiment. Therefore, configurations similar to the first embodiment are either not illustrated or illustrated with the same reference numbers assigned in the drawings.

Figure 16A:
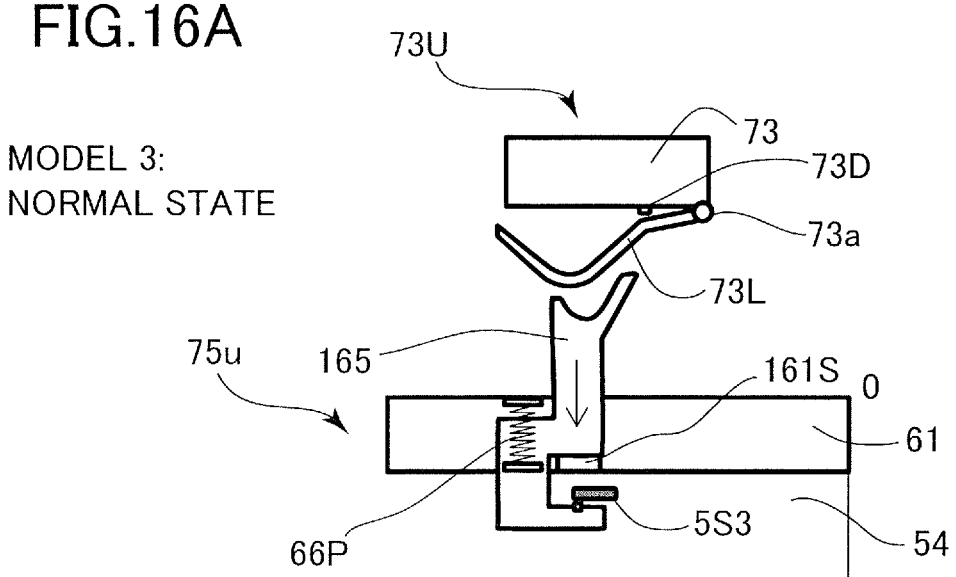
FIG. 16A is a view illustrating an all-separated state of a model 3 transfer unit in a normal state according to a second embodiment.

As illustrated in FIG. 16A, a transfer unit 75*u* serving as model 3 according to the second embodiment includes a detection lever 165 supported movably on the slider 61, and a detection lever spring 66P that urges the detection lever 165 downward. Similar to the first embodiment, the transfer unit 75*u* serving as the first unit turns to the all-separated state, the monochrome contact state and the full-color contact state, respectively, when the cam 62 serving as a first cam and a second cam rotates for 120 degrees at a time.

The slider 61 serving as a first unit movement member is provided with a contact portion 161S that contacts the detection lever 165 urged by the detection lever spring 66P and positions the detection lever 165 with respect to the slider 61. In the following description, a state in which the detection lever 165 serving as a first unit flag member contacts the contact portion 161S is referred to as a normal state.

A switch 73 and a switch lever 73L serving as a flag member for turning the switch 73 to an on state serving as a first state and an off state serving as a second state are provided on the printer body 10A (refer to FIG. 2A). The switch lever 73L is rotatably supported on a transfer frame 54 around a rotary shaft 73*a*, wherein the switch 73 is set to on state by pressing a pressure bearing portion 73D of the switch 73 and set to off state by the switch 73 separating from the pressure bearing portion 73D. The switch 73 outputs different detection signals corresponding to the on state and the off state.

Further, the switch lever 73L is retained so that the switch 73 is set to the off state in a natural state. The switch 73 and the switch lever 73L constitute a sensor unit 73U serving as a detection portion.

Figure 16B:
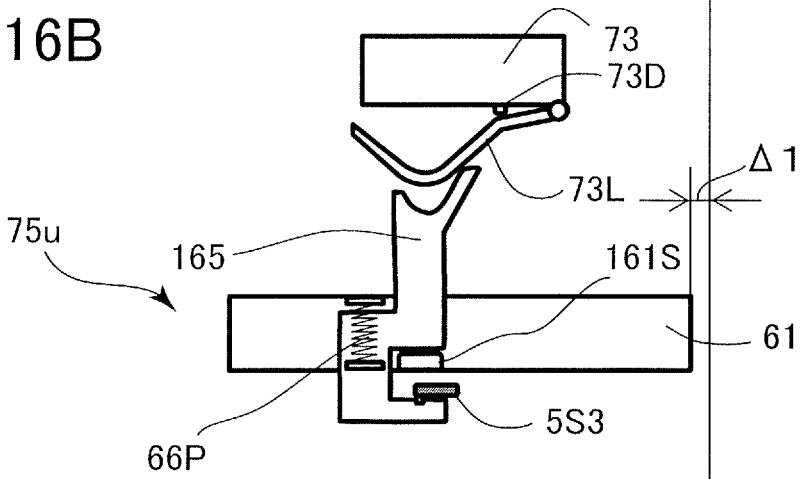
FIG. 16B is a view illustrating a monochrome contact state of the same.
Figure 16C:
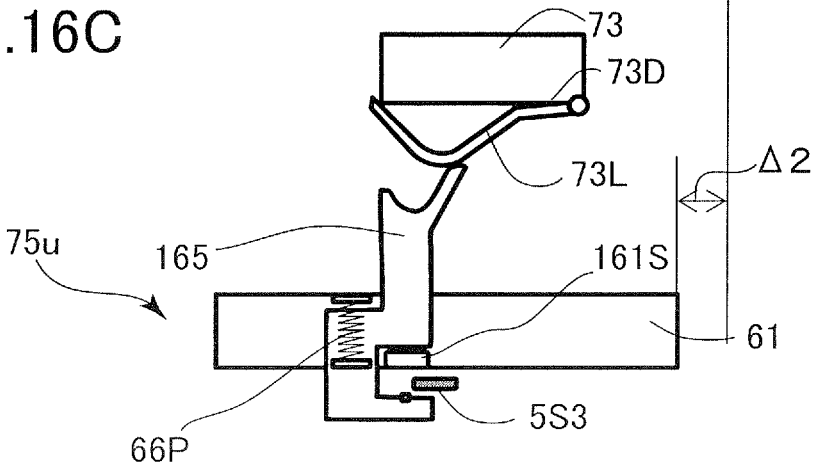
FIG. 16C is a view illustrating a full-color contact state of the same.

FIGS. 16A through 16C illustrate an all-separated state, a monochrome contact state and a full-color contact state of the model 3 transfer unit 75*u* in a normal state. Further, FIGS. 17A through 17C illustrate states of detection of the switch 73 in the respective states illustrated in FIGS. 16A through 16C.

Figure 17A:
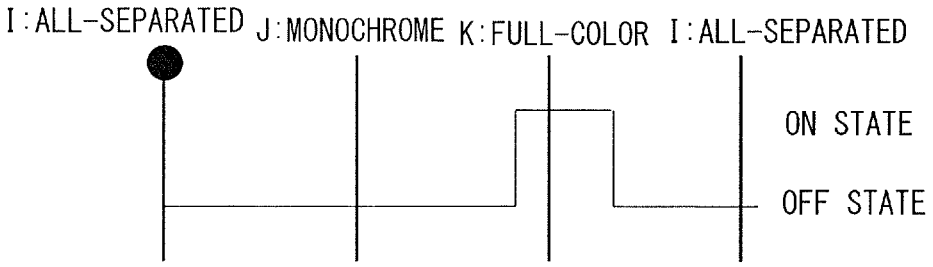
FIG. 17A is a view illustrating a detection pattern of a switch according to an all-separated state of a model 3 transfer unit in a normal state.
Figure 17B:
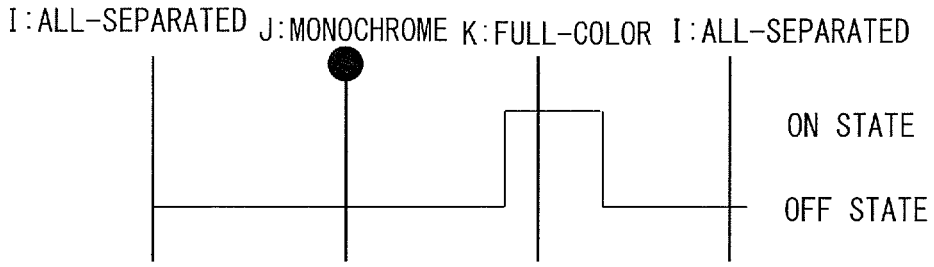
FIG. 17B is a view illustrating a detection pattern of a switch according to a monochrome contact state of the same.
Figure 17C:
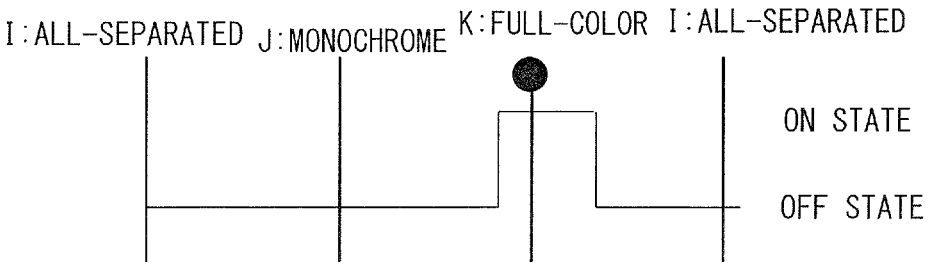
FIG. 17C is a view illustrating a detection pattern of a switch according to a full-color contact state of the same.

As illustrated in FIG. 16A, if the model 3 transfer unit 75*u* in the normal state is in the all-separated state, the detection lever 165 is separated from the switch lever 73L, and the switch 73 is in the off state, as illustrated in FIG. 17A.

As illustrated in FIG. 16B, if the transfer unit 75*u* is turned from the all-separated state to the monochrome contact state by having the cam 62 rotate for 120 degrees, the slider 61 moves in sliding motion for distance Δ1 from a reference position (0). Thereby, a relative position of the detection lever 165 supported on the slider 61 with respect to the switch lever 73L is changed. Specifically, the detection lever 165 starts to contact the switch lever 73L. In this state, the detection lever 165 is still separated from the pressure bearing portion 73D of the switch 73, and the switch 73 is in the off state, as illustrated in FIG. 17B.

Then, as illustrated in FIG. 16C, if the transfer unit 75*u* is turned from the monochrome contact state to the full-color contact state by the cam 62 rotating further for 120 degrees, the slider 61 moves in sliding motion for distance Δ2 from the reference position (0) and stops. Thereby, the switch lever 73L is pushed upward by the detection lever 165 and the switch lever 73L presses the pressure bearing portion 73D of the switch 73. Therefore, the switch 73 is in an on state, as illustrated in FIG. 17C. These three states are repeated in a reciprocating motion by the rotation of the cam 62.

Figure 18A:
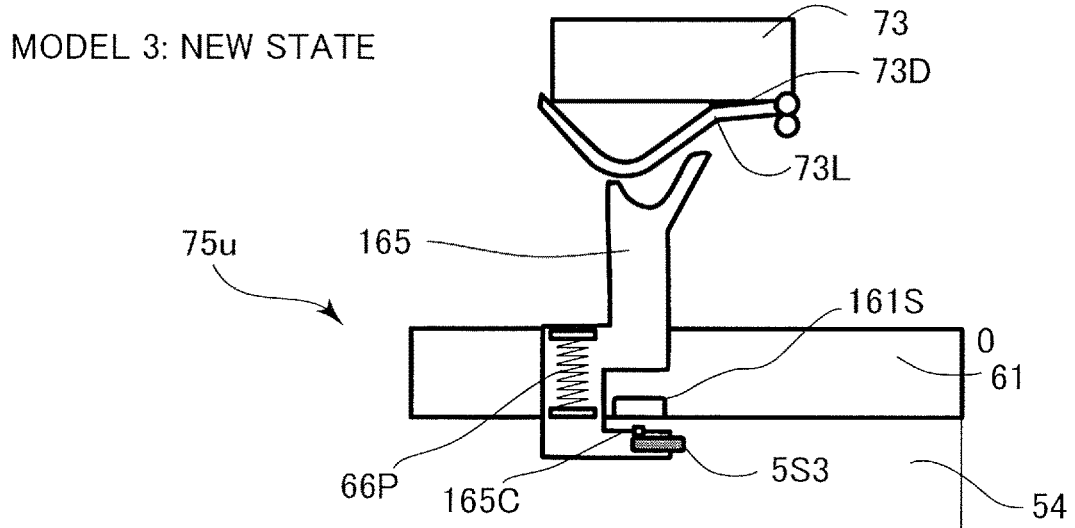
FIG. 18A is a view illustrating an all-separated state of a model 3 transfer unit in a new state.
Figure 18B:
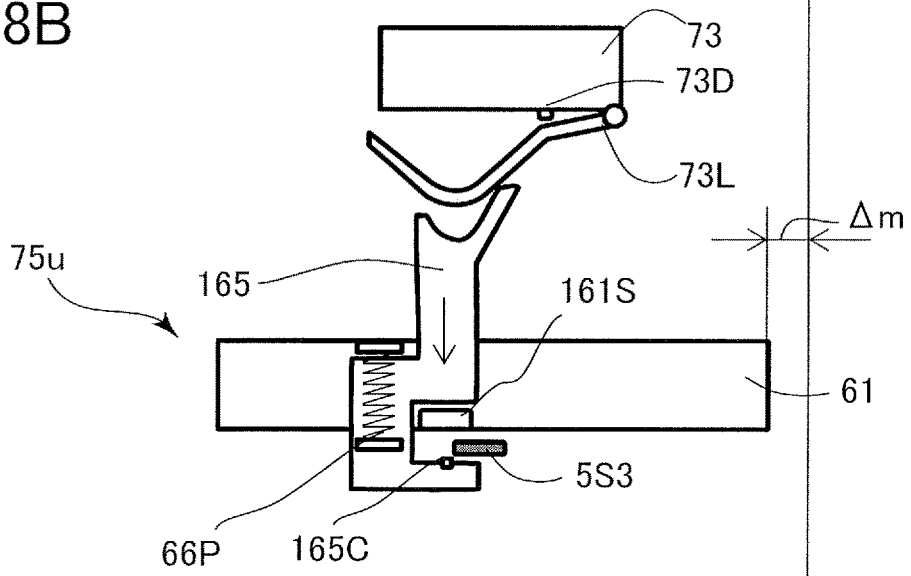
FIG. 18B is a view illustrating a monochrome contact state of the same.
Figure 18C:
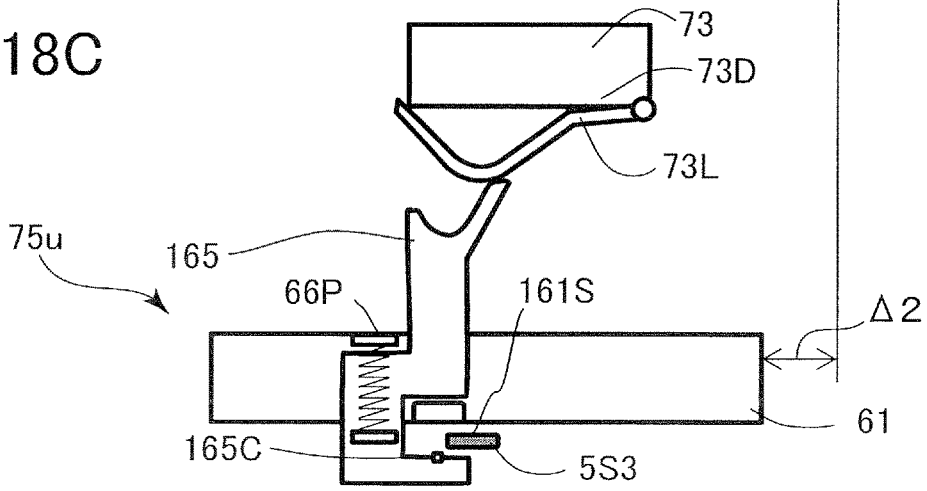
FIG. 18C is a view illustrating a full-color contact state of the same.
Figure 19A:
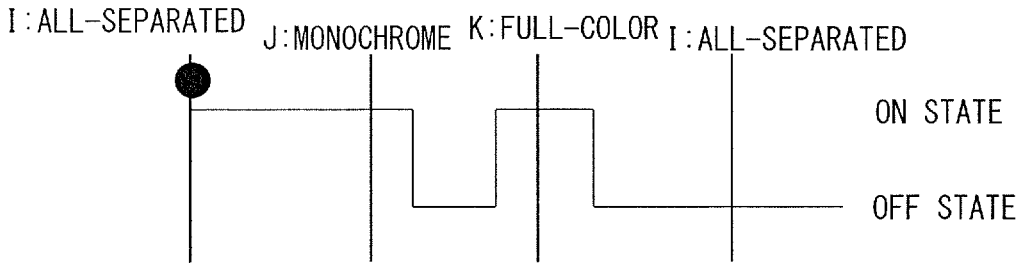
FIG. 19A is a view illustrating a detection pattern of a switch according to an all-separated state of the model 3 transfer unit in a new state.
Figure 19B:
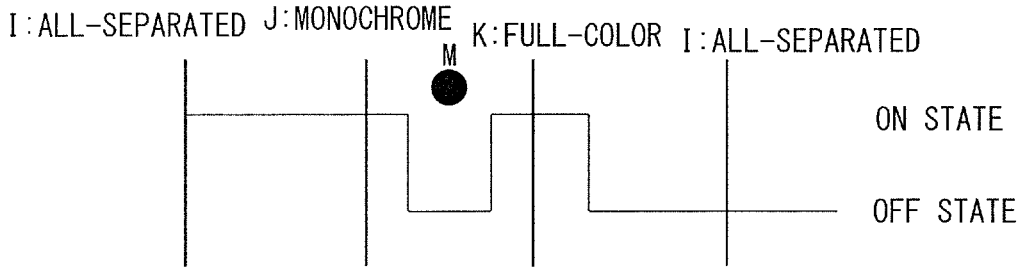
FIG. 19B is a view illustrating a detection pattern of the switch according to a monochrome contact state of the same.
Figure 19C:
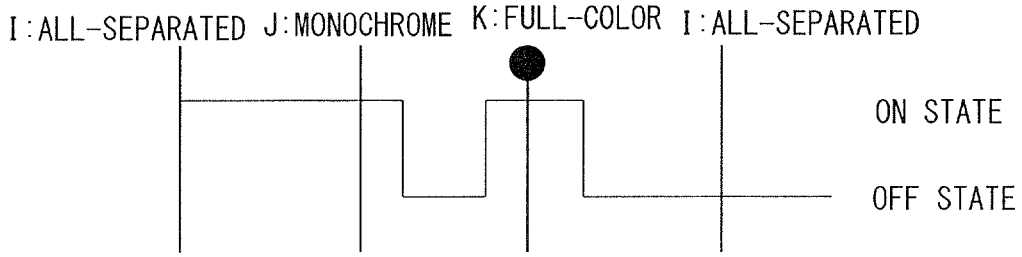
FIG. 19C is a view illustrating a detection pattern of the switch according to a full-color contact state of the same.

Next, we will describe a detection pattern of the switch 73 in the model 3 transfer unit 75*u* in a new state. FIGS. 18A through 18C respectively illustrate the all-separated state, a state during transition from the monochrome contact state to the full-color contact state, and the full-color contact state of the model 3 transfer unit 75*u* in a new state. Further, FIGS. 19A through 19C illustrate states of detection of the switch 73 in the respective states illustrated in FIGS. 18A through 18C.

In the transfer frame 54 serving as a first unit body, a third stopper 5S3 is provided below the contact portion 161S, as illustrated in FIG. 18A. The detection lever 165 of the model 3 transfer unit 75*u* in the new state has an abutment portion 165C capable of being in contact with the third stopper 5S3, and in the initial state, the detection lever 165 is positioned by being in contact with the third stopper 5S3 and in the all-separated state. That is, the detection lever 165 of the model 3 transfer unit 75*u* in the new state has the abutment portion 165C arranged upstream of the third stopper 5S3 with respect to an urging direction of the detection lever spring 66P.

As illustrated in FIG. 18A, if the model 3 transfer unit 75*u* in the new state is in the all-separated state, the switch lever 73L is pushed upward by the detection lever 165, and the switch lever 73L presses the pressure bearing portion 73D of the switch 73. Therefore, the switch 73 is in the on state, as illustrated in FIG. 19A. In this state, the slider 61 is positioned at the same position as the reference position (0) illustrated in FIG. 16A. Next, in a monochrome contact state (not shown), the detection lever 165 keeps pushing the switch lever 73L upward, and the switch 73 is in the on state.

FIG. 18B illustrates a state during transition from the monochrome contact state to the full-color contact state, in which the slider 61 is slid for distance Δm from the reference position (0). In this state, the detection lever 165 is released from the third stopper 5S3 and starts to slide downward by urging force of the detection lever spring 66P. In a state in which the detection lever 165 moves downward, the detection lever 165 temporarily separates from the switch lever 73L, such that the switch 73 is in the off state, as illustrated in FIG. 19B. Thereafter, the detection lever 165 contacts the contact portion 161S and will be in a normal state.

As illustrated in FIG. 18C, if the transfer unit 75*u* is turned from the monochrome contact state to the full-color contact state by the cam 62 rotating further for 120 degrees, the slider 61 moves in sliding motion for distance Δ2 from the reference position (0) and stops. In this state, the switch lever 73L is pushed upward by the detection lever 165 in the normal state and will be in a state similar to FIG. 16C. Thereby, the switch 73 will be in an on state, as illustrated in FIG. 19C. Thereafter, the detection lever 165 will maintain the normal state where it is in contact with the contact portion 161S, so that the three states illustrated in FIGS. 16A through 16C are repeated in a reciprocating motion by the rotation of the cam 62.

Figure 20A:
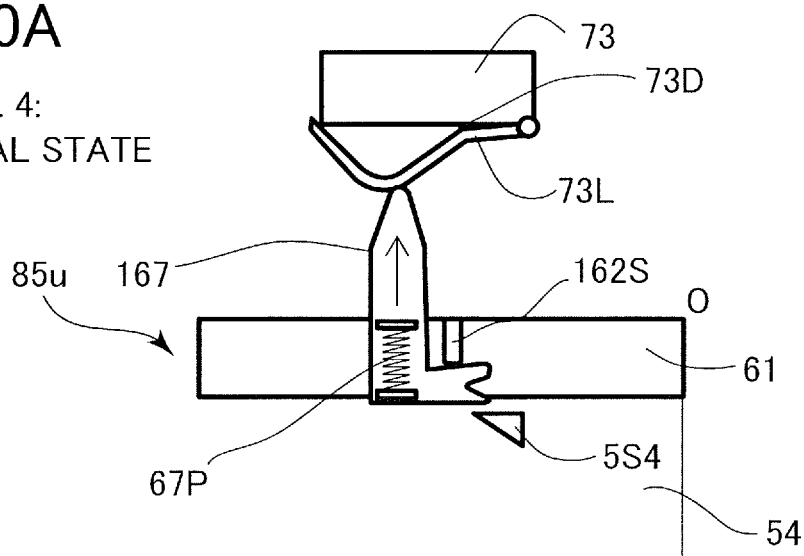
FIG. 20A is a view illustrating an all-separated state of a model 4 transfer unit in a normal state.

Next, a model 4 transfer unit 85*u* serving as a second unit will be described with reference to FIG. 20A. As illustrated in FIG. 20A, the transfer unit 85*u* includes a detection lever 167 supported movably on the slider 61, and a detection lever spring 67P that urges the detection lever 167 upward. Similar to the first embodiment, the transfer unit 85*u* is turned to the all-separated state, the monochrome contact state and the full-color contact state by the cam 62 rotating for 120 degrees at a time.

Further, a contact portion 162S for being in contact with the detection lever 167 urged by the detection lever spring 67P and positioning the detection lever 167 with respect to the slider 61 is provided on the slider 61 serving as the second unit movement member. In the following description, a state in which the detection lever 167 serving as the second unit flag member is in contact with the contact portion 162S is referred to as a normal state.

Figure 20B:
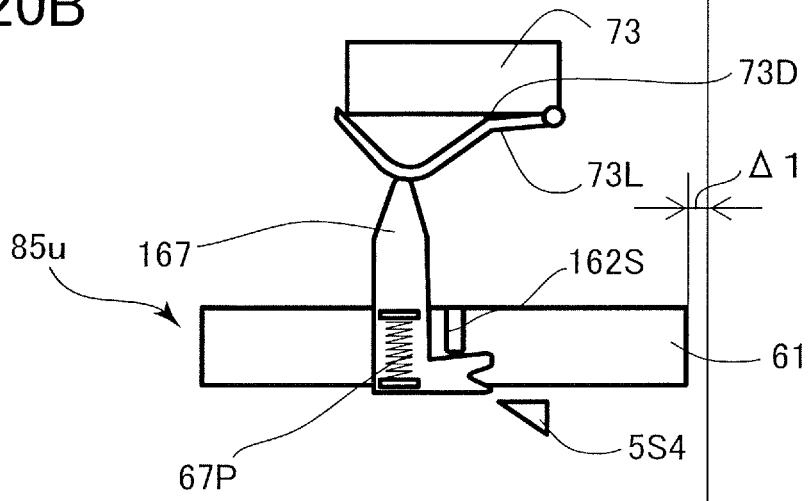
FIG. 20B is a view illustrating a monochrome contact state of the same.
Figure 20C:
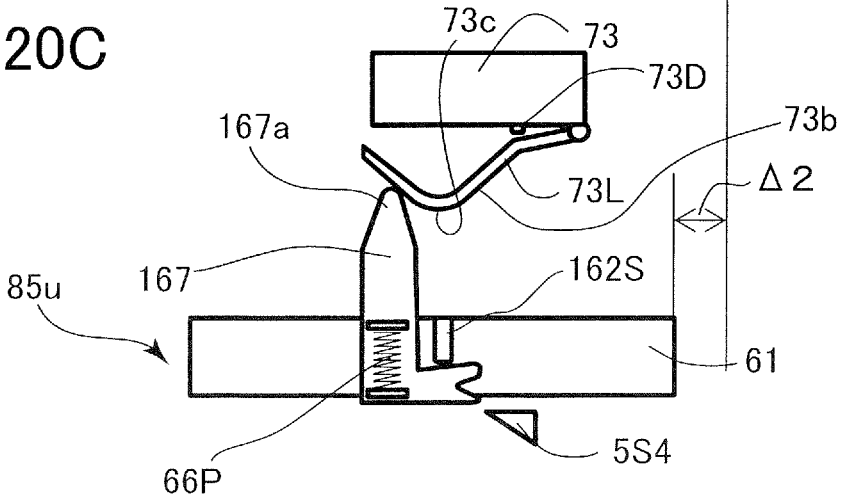
FIG. 20C is a view illustrating a full-color contact state of the same.

FIGS. 20A through 20C illustrate a model 4 transfer unit 85*u* in the normal state in the respective states of the all-separated state, the monochrome contact state and the full-color contact state. Further, FIGS. 21A through 21C illustrate states of detection of the switch 73 corresponding to the respective states of FIGS. 20A through 20C.

Figure 21A:
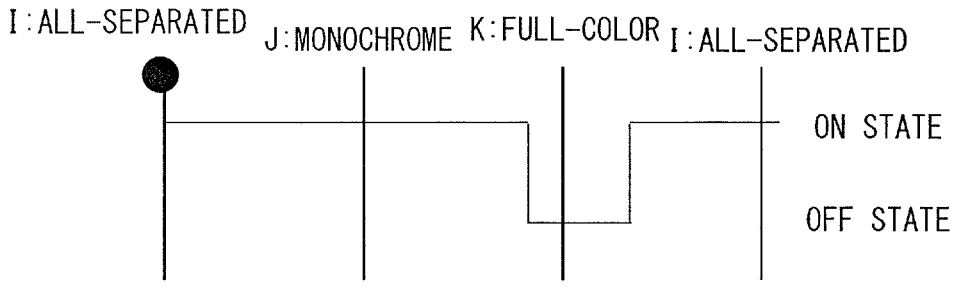
FIG. 21A is a view illustrating a detection pattern of a switch according to an all-separated state of the model 4 transfer unit in a normal state.
Figure 21B:
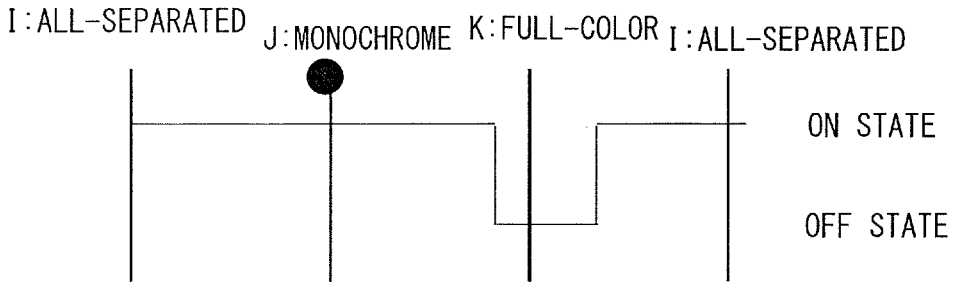
FIG. 21B is a view illustrating a detection pattern of the switch according to a monochrome contact state of the same.
Figure 21C:
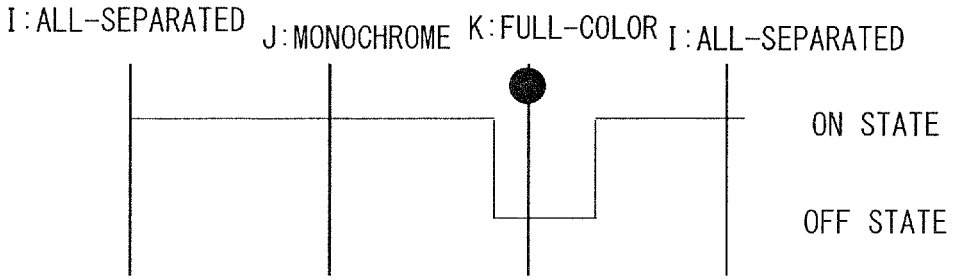
FIG. 21C is a view illustrating a detection pattern of the switch according to a full-color contact state of the same.

As illustrated in FIG. 20A, if the model 4 transfer unit 85*u* in the normal state is in the all-separated state, the detection lever 167 presses the switch lever 73L upward, and the switch 73 is in the on state, as illustrated in FIG. 21A.

As illustrated in FIG. 20B, if the transfer unit 85*u* is turned from the all-separated state to the monochrome contact state by having the cam 62 rotate for 120 degrees, the slider 61 moves in sliding motion for distance Δ1 from the reference position (0). Thereby, a relative position of the detection lever 167 supported on the slider 61 with respect to the switch lever 73L is changed. In this state, the switch lever 73L still presses the pressure bearing portion 73D of the switch 73, and the switch 73 is in an on state, as illustrated in FIG. 21B.

Then, as illustrated in FIG. 20C, if the transfer unit 85*u* is turned from the monochrome contact state to the full-color contact state by the cam 62 further rotating for 120 degrees, the slider 61 moves in sliding motion for distance Δ2 from the reference position (0) and stops. In this state, an upper end portion 167*a* of the detection lever 167 passes an apex portion 73*c* of an operation surface 73*b* of the switch lever 73L. Therefore, the switch lever 73L is lowered, and the switch lever 73L separates from the pressure bearing portion 73D of the switch 73. Thus, the switch 73 will be in an off state, as illustrated in FIG. 21C. These three states will be repeated in reciprocating motion by the rotation of the cam 62.

Figure 22A:
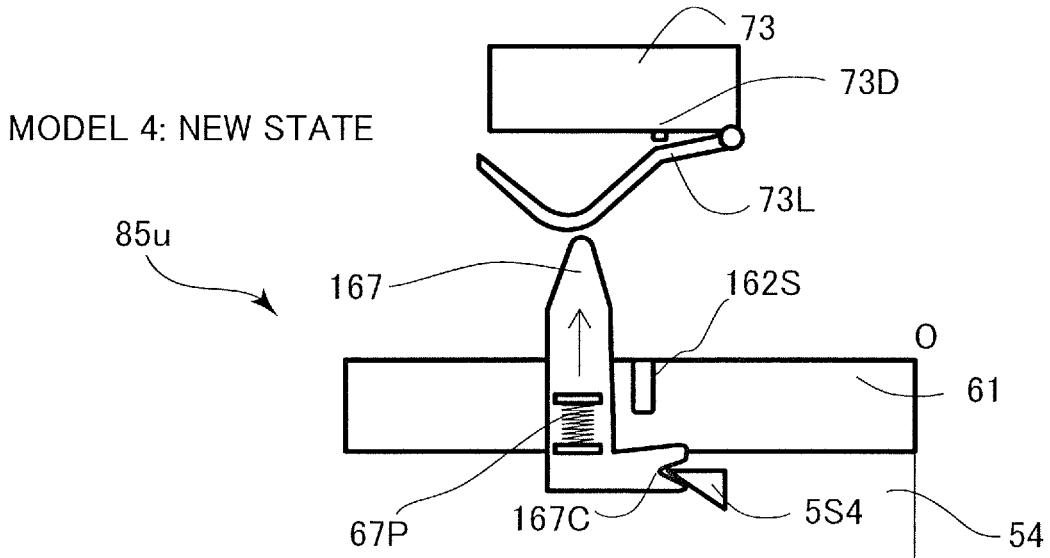
FIG. 22A is a view illustrating an all-separated state of a model 4 transfer unit in a new state.
Figure 22B:
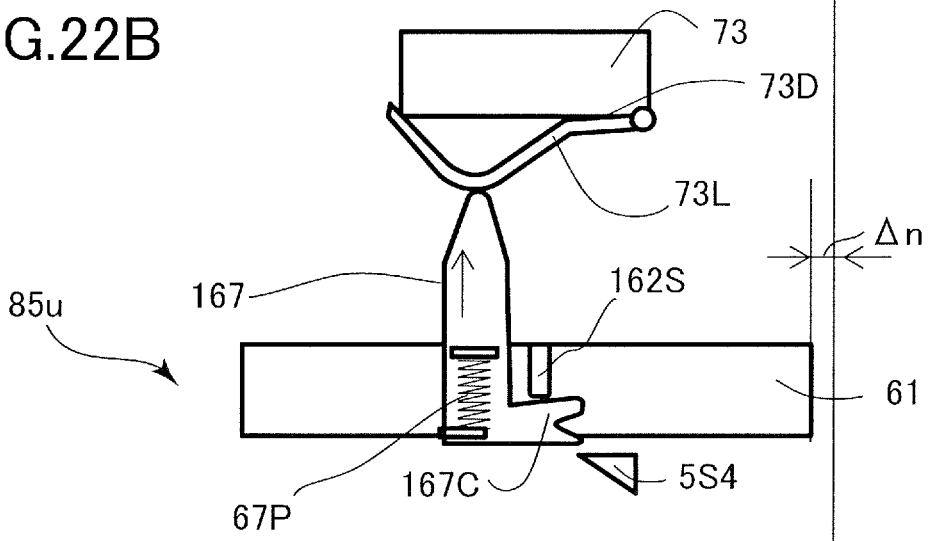
FIG. 22B is a view illustrating a state during transition from the all-separated state to a monochrome contact state of the same.
Figure 22C:
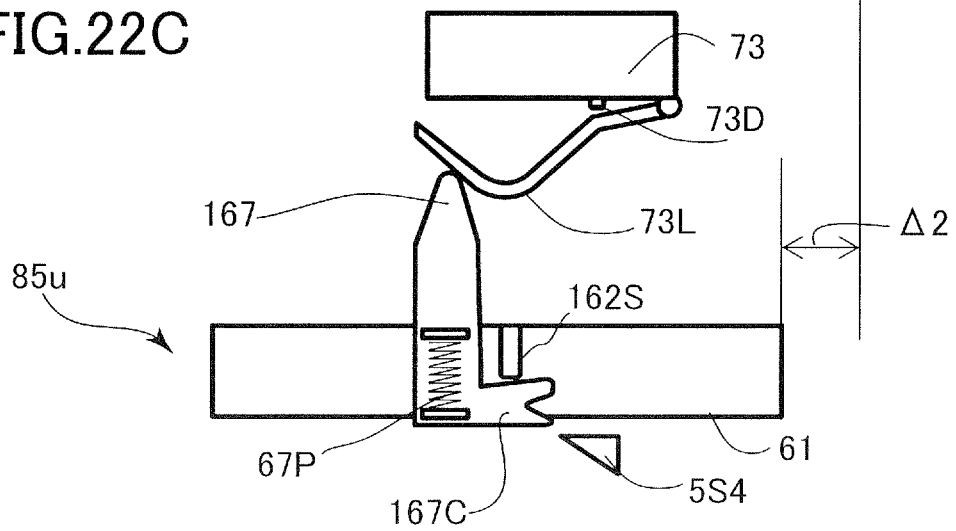
FIG. 22C is a view illustrating a full-color contact state of the same.

Next, we will describe detection patterns of the switch 73 in the model 4 transfer unit 85*u* in a new state. FIGS. 22A through 22C respectively illustrate the all-separated state, a state during transition from the all-separated state to the monochrome contact state, and the full-color contact state of the model 4 transfer unit 85*u* in a new state. Further, FIGS. 23A through 23C illustrate states of detection of the switch 73 in the respective states illustrated in FIGS. 20A through 20C.

As illustrated in FIG. 20A, in the transfer frame 54 serving as a second unit body, a fourth stopper 5S4 is provided below the contact portion 162S. The detection lever 167 of the model 4 transfer unit 85*u* in the new state has a locking portion 167C that is lockable to the fourth stopper 5S4, and in the initial state, the detection lever 167 is positioned by being in contact with the fourth stopper 5 S4 and in the all-separated state.

Figure 23A:
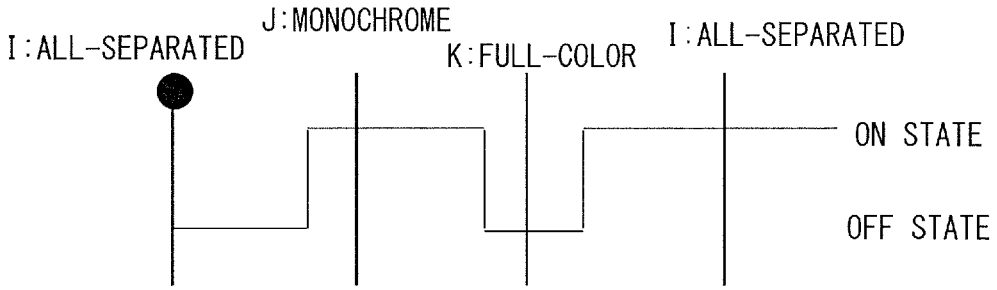
FIG. 23A is a view illustrating a detection pattern of a switch according to the all-separated state of a model 4 transfer unit in a new state.
Figure 23B:
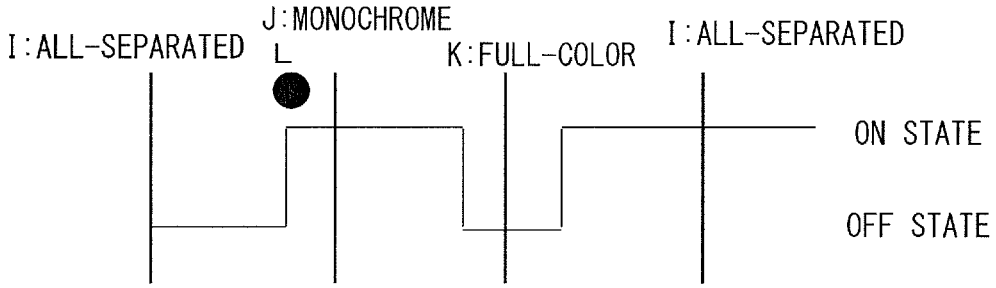
FIG. 23B is a view illustrating a detection pattern of the switch according to a state during transition from the all-separated state to a monochrome contact state of the same.
Figure 23C:
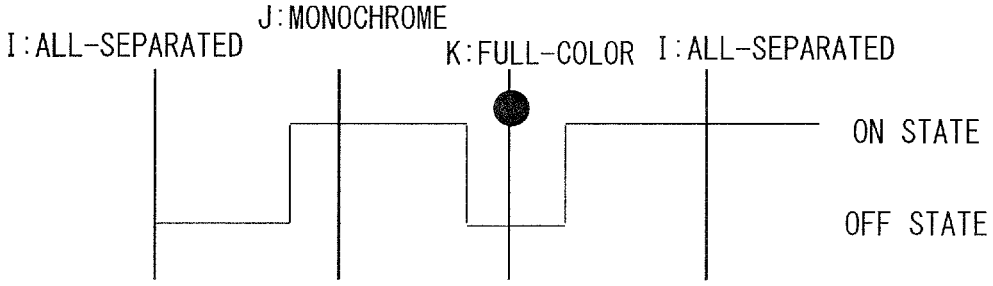
FIG. 23C is a view illustrating a detection pattern of the switch according to a full-color contact state of the same.

As illustrated in FIG. 22A, if the model 4 transfer unit 85*u* in the new state is in the all-separated state, the detection lever 167 is separated from the switch lever 73L, and the switch 73 is in an off state, as illustrated in FIG. 23A. In this state, the slider 61 is positioned at the same position as the reference position (0) illustrated in FIG. 21A.

FIG. 22B illustrates a state during transition from the all-separated state to the monochrome contact state, in which the slider 61 is slid for distance Δn from the reference position (0). In this state, the detection lever 167 is released from the fourth stopper 5S4 and starts to slide upward by urging force of the detection lever spring 67P. The detection lever 167 that has slid upward contacts the contact portion 162S and stops, and will be in a normal state. When the detection lever 167 moves upward, the switch lever 73L is pushed upward by the detection lever 167. Thereby, the switch lever 73L presses the pressure bearing portion 73D of the switch 73, and the switch 73 will be in an on state, as illustrated in FIG. 23B.

If the state is turned to a monochrome contact state (not shown), the detection lever 167 keeps pushing the switch lever 73L upward, and the switch 73 is in an on state. As illustrated in FIG. 22C, if the cam 62 rotates further for 120 degrees from the monochrome contact state and realizes a full-color contact state, the slider 61 moves in sliding motion for distance Δ2 from the reference position (0) and stops. In this state, the switch lever 73L will be in a state similar to the detection lever 167 in the normal state, as illustrated in FIG. 20C. Thereby, the switch 73 will be in an off state, as illustrated in FIG. 23C.

Thereafter, the detection lever 167 will maintain the normal state where it is in contact with the contact portion 162S, so that the three states illustrated in FIGS. 20A through 20C are repeated in a reciprocating motion by the rotation of the cam 62. The initial control of the state where the transfer unit 75*u* or 85*u* is attached to the printer body 10A is similar to the first embodiment, so that the description thereof will be omitted.

As described, the present embodiment enables to perform detection of contact states, i.e., all-separated state, monochrome contact state and full-color contact state, of the transfer unit, old/new detection and type detection, by providing detection levers that differ according to each model. The printer body 10A and the controller 100 constitute a discrimination system for discriminating the unit attached to the printer body 10A.

Third Embodiment

Next, a third embodiment of the present invention will be described, wherein according to the third embodiment, a flag member 74L is provided instead of the flag member 70 of the first embodiment. Therefore, the configurations similar to the first embodiment are either not shown in the drawing or denoted with the same reference numbers.

Figure 24A:
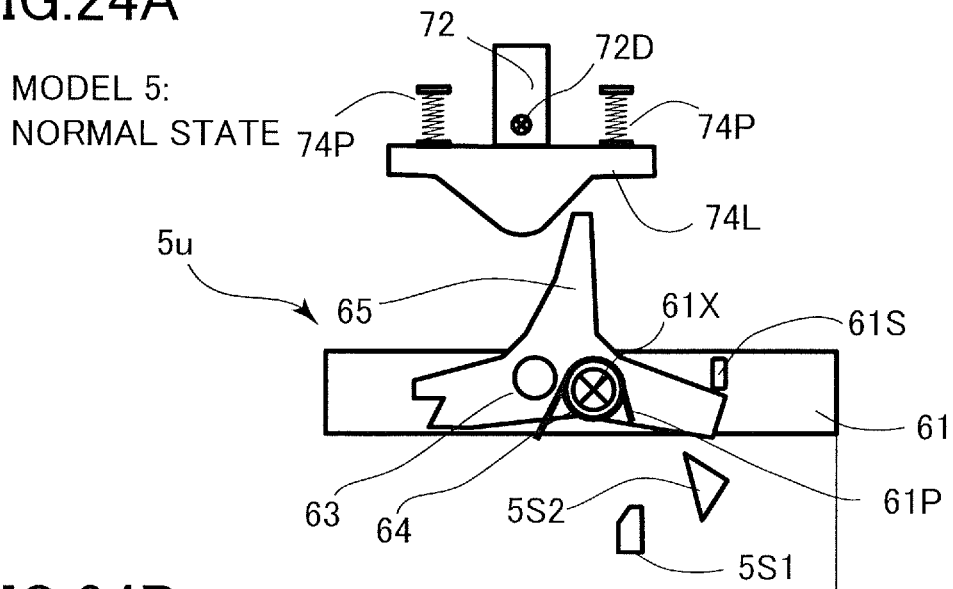
FIG. 24A is a view illustrating an all-separated state of a flag member of a photosensor according to a third embodiment.
Figure 24B:
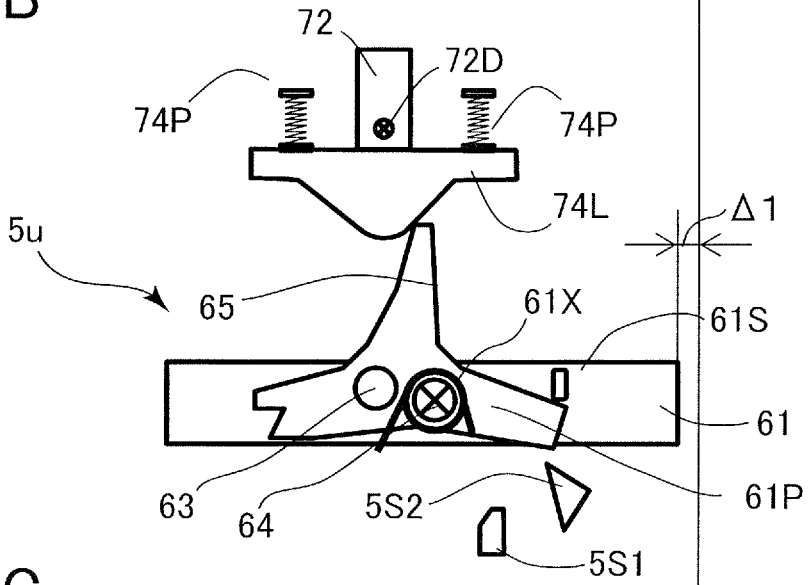
FIG. 24B is a view illustrating a monochrome contact state of the same.
Figure 24C:
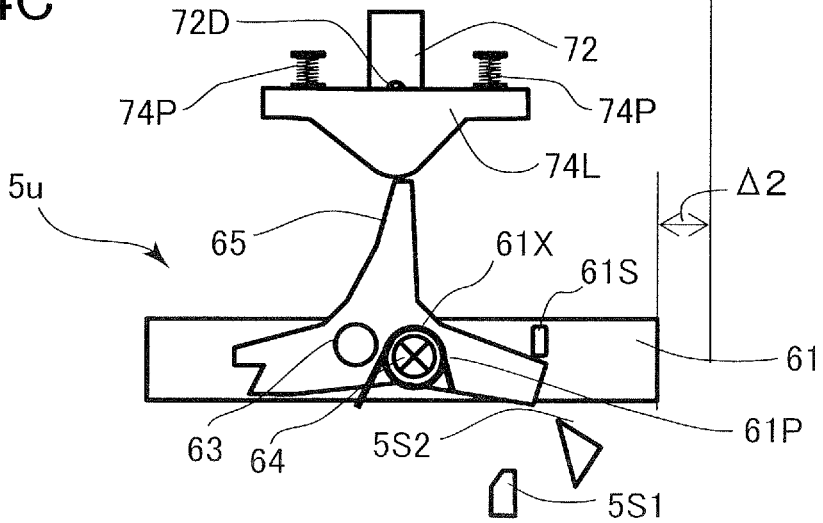
FIG. 24C is a view illustrating a full-color contact state of the same.

As illustrated in FIG. 24A, the flag member 74L is retained slidably in up-down directions by two springs 74P and 74P. The only difference from FIGS. 6A through 6C is that the flag member of the photosensor 72 is composed of a slidable flag member 74L in FIGS. 24A through 24C, and the other configurations and detection patterns are the same as the first embodiment.

In the first to third embodiments, the photosensor 72 and the switch 73 which are binary detection units are illustrated as detection units, but other units can be adopted as long as the unit similarly discriminates binary data. Further, it is also possible to provide the switch lever 73L of the switch 73 described in the second embodiment in a slidable manner, similar to the flag member 74L.

Further, in the initial control after replacing the transfer unit, the cam 62 is rotated once after the right door Rd has been closed, that is, when the open/close detection sensor 90 was turned on, but the present invention is not restricted thereto. For example, it is possible to provide a sensor for detecting that a transfer unit has been attached to the printer body, and the cam 62 can be rotated once at a timing when this sensor is turned on. Furthermore, the cam 62 may be rotated not only once, but for 240 degrees, or rotated twice, and so on.

In any of the illustrated embodiments, a transfer unit has been described as the sample, but the present invention is not restricted thereto. For example, it may be possible to use a binary detection unit for detecting a nip pressure of the fixing unit to perform old/new detection and type determination of the fixing unit. Moreover, the present invention is applicable not only to an electro-photographic printer 10, but also to an ink-jet image forming apparatus in which images are formed on sheets by discharging ink through nozzles.

Moreover, the slider 61 may be configured to move not only by sliding, but by other movements such as rotation. In the first embodiment, the detection lever 65 includes first and second hole portions 63 and 64, and the slider 61 has the shaft portion 61X, but the present invention is not restricted thereto. That is, a configuration can be adopted where the detection lever 65 has the shaft portion 61X that protrudes from the first and second surfaces 65A and 65B, and the slider 61 has the first and second hole portions 63 and 64.

In any of the aforementioned embodiments, a cam having three rotation positions has been described as an example, but the present invention is not restricted thereto. For example, the cam may have two rotation positions, and the rotation of the cam may cause the transfer unit to turn between the all-separated state and the full-color contact state. Similarly, the cam may have four or more rotation positions. The first, second and third embodiments can be combined arbitrarily. For example, in the first embodiment, the sensor unit 72U can be replaced with the sensor unit 73U of the second embodiment.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-190139 filed Sep. 29, 2017, which is hereby incorporated by reference herein in its entirety.

What is claimed is:

1. An image forming apparatus comprising:

an apparatus body comprising an image forming portion configured to form an image, and a detection portion configured to turn in a first state and a second state and configured to output a detection signal corresponding to the first state and the second state; and a unit detachably mounted to the apparatus body and comprising a unit body, a cam rotatably supported on the unit body and configured to be positioned at least at two rotation positions, a first movement member configured to move with respect to the unit body by rotation of the cam, and a second movement member movably supported with respect to the first movement member and turning the detection portion to the first state and to the second state by movement of the first movement member, wherein the unit comprises a first contact portion provided on the first movement member and being in contact with the second movement member so as to position the second movement member with respect to the first movement member, an urging portion configured to urge the second movement member toward the first contact portion, and a second contact portion provided on the unit body and configured to contact the second movement member separated from the first contact portion and urged by the urging portion, the second movement member is attachable to the first movement member in a first manner or a second manner that differs from the first manner, in a state in which the second movement member, regardless of the first and second manners, is in contact with the second contact portion, the second movement member moves away from the second contact portion while the cam rotates once so that the second movement member is positioned at the first contact portion by urging force of the urging portion, in a state in which the second movement member is attached to the first movement member in the first manner, if the cam starts to rotate in an initial condition in which the second movement member is in contact with the second contact portion, the detection portion outputs detection signals with a first detection pattern while the cam rotates once, and in a state in which the second movement member is attached to the first movement member in the second manner, if the cam starts to rotate in an initial condition in which the second movement member is in contact with the second contact portion, the detection portion outputs detection signals with a second detection pattern which is different from the first detection pattern while the cam rotates once.

2. The image forming apparatus according to claim 1, wherein in a state in which the second movement member is is attached to the first movement member in the first manner, if the cam starts to rotate in an initial condition in which the second movement member is in contact with the first contact portion, the detection portion outputs detection signals with a third detection pattern while the cam rotates once, and in a state in which the second movement member is attached to the first movement member in the second manner, if the cam starts to rotate in an initial condition in which the second movement member is in contact with the first contact portion, the detection portion outputs detection signals with a fourth detection pattern which is different from the third detection pattern while the cam rotates once.

3. The image forming apparatus according to claim 1, wherein the image forming portion comprises a plurality of image bearing members configured to respectively bear toner images to be transferred to a sheet, and the unit comprises an intermediate transfer body to which the toner images borne on the plurality of image bearing members are transferred, a plurality of transfer members configured to respectively transfer the toner images on the plurality of image bearing members to the intermediate transfer body by being applied with a primary transfer bias, and a contact/separation mechanism configured to contact and separate the plurality of transfer members to and from the intermediate transfer body in response to a position of the first movement member.

4. The image forming apparatus according to claim 3, wherein the cam is configured to be positioned at a first rotation position, a second rotation position and a third rotation position, all of the plurality of transfer members are separated from the intermediate transfer body in a state in which the cam is positioned at the first rotation position, only one of the plurality of transfer members is in contact with the intermediate transfer body in a state in which the cam is positioned at the second rotation position, and all of the plurality of transfer members are in contact with the intermediate transfer body in a state in which the cam is positioned at the third rotation position.

5. The image forming apparatus according to claim 3, further comprising a controller configured to detect a contact/separation state of each of the plurality of transfer members with respect to the intermediate transfer body in response to a detection pattern of the detection signals output by the detection portion in a state in which the second movement member is in contact with the first contact portion.

6. The image forming apparatus according to claim 1, wherein the second movement member attached to the first movement member in the second manner is inverted with respect to the second movement member attached to the first movement member in the first manner.

7. The image forming apparatus according to claim 1, wherein one of the first movement member and the second movement member comprises a shaft portion around which the second movement member rotates, the other of the first movement member and the second movement member comprises a first hole portion and a second hole portion each configured to be engaged with the shaft portion, and the shaft portion engages with the first hole portion in a state in which the second movement member is attached to the first movement member in the first manner, and engages with the second hole portion in a state in which the second movement member is attached to the first movement member in the second manner.

8. The image forming apparatus according to claim 7, wherein the first movement member comprises the shaft portion that rotatably supports the second movement member, and the second movement member comprises the first hole portion and the second hole portion that are engageable with the shaft portion of the first movement member.

9. The image forming apparatus according to claim 7, wherein the first movement member is configured to reciprocate in a direction orthogonal to an axial direction of the shaft portion by the cam rotated in a state in contact with the first movement member.

10. The image forming apparatus according to claim 1, wherein the second contact portion comprises a first stopper configured to be in contact with the second movement member attached in the first manner and a second stopper configured to be in contact with the second movement member attached in the second manner.

11. The image forming apparatus according to claim 1, wherein the detection portion comprises a flag member configured to move by being pressed by the second movement member, and a photosensor configured to turn to the first state where an optical path is blocked by the flag member and turn to the second state where the optical path is opened.

12. The image forming apparatus according to claim 11, wherein the flag member is supported pivotably on the apparatus body.

13. The image forming apparatus according to claim 11, wherein the flag member is supported slidably on the apparatus body.

14. The image forming apparatus according to claim 1, wherein the detection portion comprises a flag member configured to move by being pressed by the second movement member, and a switch configured to turn to the first state by being pressed by the flag member and turn to the second state by being away from the flag member.

15. The image forming apparatus according to claim 14, wherein the flag member is supported pivotably on the apparatus body.

16. The image forming apparatus according to claim 14, wherein the flag member is supported slidably on the apparatus body.

17. The image forming apparatus according to claim 1, further comprising a controller configured to discriminate whether the unit attached to the apparatus body has the second movement member attached in the first manner or has the second movement member attached in the second manner, based on a difference of a detection pattern of the detection signals output by the detection portion.

18. The image forming apparatus according to claim 1, wherein, if the cam starts to rotate in an initial condition in which the second movement member is in contact with the first contact portion, the detection portion outputs detection signals with a third detection pattern while the cam rotates once, and if the cam starts to rotate in an initial condition in which the second movement member is in contact with the second contact portion, the detection portion outputs detection signals with a fourth detection pattern which is different from the third detection pattern while the cam rotates once in an initial condition in which the second movement member is in contact with the second contact portion.

19. A discrimination system comprising:

an apparatus body comprising an image forming portion configured to form an image, and a detection portion configured to turn in a first state and a second state and configured to output a detection signal corresponding to the first state and the second state; and a controller configured to discriminate whether a unit attached to the apparatus body is a first unit or a second unit, wherein the first unit is detachably mounted to the apparatus body and comprises a first unit body, a first cam rotatably supported on the first unit body and configured to be positioned at least at two rotation positions, a first unit movement member configured to move with respect to the first unit body by rotation of the first cam, and a first unit flag member movably supported with respect to the first unit movement member and turning the detection portion to the first state and to the second state by movement of the first unit movement member, the second unit is detachably mounted to the apparatus body and comprises a second unit body, a second cam rotatably supported on the second unit body and configured to be positioned at least at two rotation positions, a second unit movement member configured to move with respect to the second unit body by rotation of the second cam, and a second unit flag member movably supported with respect to the second unit movement member and turning the detection portion to the first state and to the second state by movement of the second unit movement member, and the controller is configured to discriminate whether a unit attached to the apparatus body is the first unit or the second unit based on a difference between a detection pattern of the detection signal output by the detection portion while the first cam or the second cam rotates once.

20. An image forming apparatus comprising:

an apparatus body comprising an image forming portion configured to form an image, and a detection portion configured to turn in a first state and a second state and configured to output a detection signal corresponding to the first state and the second state;

a unit detachably mounted to the apparatus body and comprising a unit body, a cam rotatably supported on the unit body and configured to be positioned at least at two rotation positions, and a movement member configured to move with respect to the unit body by rotation of the cam; and a controller configured to discriminate the unit attached to the apparatus body, wherein the detection portion outputs detection signals with a first detection pattern while the cam rotates once in a case in which a first unit as the unit is attached to the apparatus body, the first unit comprising a first unit flag member movably supported with respect to the movement member and turning the detection portion to the first state and to the second state by movement of the movement member, the detection portion outputs detection signals with a second detection pattern while the cam rotates once in a case in which a second unit as the unit is attached to the apparatus body, the second unit comprising a second unit flag member movably supported with respect to the movement member and turning the detection portion to the first state and to the second state by movement of the movement member, and the controller discriminates that the first unit is attached to the apparatus body in a case in which the detection portion outputs the first detection pattern, and discriminates that the second unit is attached to the apparatus body in a case in which the detection portion outputs the second detection pattern.

21. The image forming apparatus according to claim 20, wherein the image forming portion comprises a plurality of image bearing members configured to respectively bear toner images to be transferred to a sheet, and the unit comprises an intermediate transfer body to which the toner images borne on the plurality of image bearing members are transferred, a plurality of transfer members configured to respectively transfer the toner images on the plurality of image bearing members to the intermediate transfer body by being applied with a primary transfer bias, and a contact/separation mechanism configured to contact and separate the plurality of transfer members to and from the intermediate transfer body in response to a position of the movement member.

22. The image forming apparatus according to claim 21, wherein the cam is configured to be positioned at a first rotation position, a second rotation position and a third rotation position, all of the plurality of transfer members are separated from the intermediate transfer body in a state in which the cam is positioned at the first rotation position, only one of the plurality of transfer members is in contact with the intermediate transfer body in a state in which the cam is positioned at the second rotation position, and all of the plurality of transfer members are in contact with the intermediate transfer body in a state in which the cam is positioned at the third rotation position.

* * * * *